US006901235B2

(12) United States Patent
Shimizu et al.

(10) Patent No.: US 6,901,235 B2
(45) Date of Patent: May 31, 2005

(54) FIXING DEVICE AND IMAGE FORMING APPARATUS USING THE SAME

(75) Inventors: Tadafumi Shimizu, Ogori (JP); Shouichi Kitagawa, Fukuoka (JP); Masahiro Samei, Fukuoka (JP); Kazunori Matsuo, Oonojo (JP); Keiichi Matsuzaki, Kurume (JP); Kenji Asakura, Kyoto (JP); Hideki Tatematsu, Ashiya (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/617,419

(22) Filed: Jul. 10, 2003

(65) Prior Publication Data

US 2004/0009020 A1 Jan. 15, 2004

(30) Foreign Application Priority Data

Jul. 11, 2002 (JP) ..... P. 2002-202617
Sep. 12, 2002 (JP) ..... P. 2002-266493
Jun. 27, 2003 (JP) ..... P. 2003-184183

(51) Int. Cl.[7] ..... G03G 15/20
(52) U.S. Cl. ..... 399/328; 219/619; 399/330
(58) Field of Search ..... 219/216, 619; 399/67–70, 328, 330–334

(56) References Cited

U.S. PATENT DOCUMENTS 5,552,582 A 9/1996 Abe et al.
5,666,627 A 9/1997 Yamaguchi
5,713,069 A 1/1998 Kato
5,801,359 A 9/1998 Mano et al.
6,037,576 A 3/2000 Okabayashi et al.
6,078,781 A 6/2000 Takagi et al.
6,097,926 A 8/2000 Takagi et al.
6,195,525 B1 2/2001 Maeyama
2002/0007752 A1 1/2002 Sakagami
2002/0085867 A1 7/2002 Samei et al.

FOREIGN PATENT DOCUMENTS

EP 1 022 624 A2 7/2000
EP 1 174 774 A1 1/2002
JP 7-295414 11/1995
JP 8-22206 1/1996
JP 8-137311 5/1996
JP 10-74007 3/1998
JP 11-316509 11/1999
JP 2000-030851 1/2000
JP 2000-188177 7/2000
JP 2000-206813 7/2000
JP 2000-215974 8/2000
JP 2001-188430 7/2001

*Primary Examiner*—Hoang Ngo
(74) *Attorney, Agent, or Firm*—Pearne & Gordon LLP

(57) ABSTRACT

A fixing device is formed by using a heat generating roller having magnetism and electric conductive characteristics and a magnetizing coil opposed to the outer peripheral of the heat generating roller and generating heat on the heat generating roller by an electromagnetic induction. The magnetizing coil is formed in such a manner that 60 copper wires whose surfaces are insulated and have the outside diameter of 0.2 mm are bundled to form a bundle of wires and the bundle of wires is drawn in the direction of rotation axis of the heat generating roller and wound in the direction of a circumference of the heat generating roller. Further, the magnetizing coil is disposed so that the bundles of wires mutually come into close contact along the circumference of the heat generating roller to cover the upper half of the heat generating roller.

25 Claims, 20 Drawing Sheets

FIXING DEVICE AND IMAGE FORMING APPARATUS USING THE SAME

BACKGROUND OF THE INVENTION

The present invention relates to a fixing device used in an electrostatic recording type image forming apparatus such as a copying machine, a facsimile device, a printer, etc. and more particularly to a fixing device of a toner image using an electromagnetic inductive heating system, and an image forming apparatus using the fixing device.

In recent years, factors such as energy saving and high speed have been commercially increasingly requested for an image forming apparatus, for instance, a printer, a copying machine, a facsimile device or the like. To achieve these requested performances, it is important to improve a thermal efficiency of a fixing device employed for the image forming apparatus.

In the image forming apparatus, a non-fixed toner image is formed on a recording medium such as a sheet material, a printing sheet, a photosensitive sheet, an electrostatic recording sheet, etc. in accordance with an image transfer system or a direct system by an image forming process of electro-photographic recording, electrostatic recording, magnetic recording or the like. As fixing devices for fixing the non-fixed toner image, contact heating type fixing devices such as a heat roller system, a film heating system, an electromagnetic inductive heating system, etc. are widely employed.

As the electromagnetic inductive heating type fixing device, European Patent Publication EP-1174774 proposed that Joule heat is produced by eddy current caused in a heat generate member made of a magnetic metal member under the alternating magnetic field of inductive heating means made of a magnetizing coil. Thus, in this technique, the heat of the heat generating member is generated electromagnetically and inductively.

Since the heat roller is made of a magnetic member, a magnetic path of a magnetic flux generated by energizing a magnetizing coil is formed. However, when a back surface core does not exist, the magnetic flux leaks outside. Accordingly, the back surface core is provided to form the magnetic path to prevent the magnetic flux from leaking outside.

When a plurality of C shaped cores are provided in the direction of the circumference of the heat roller as usual, magnetic flux density in the parts of the C shaped cores is high, however, magnetic flux density in the parts where the C shaped cores are not present is low. Therefore, the temperature of the heat roller in the parts where the C-shaped cores exist excessively rises relative to the temperature of the heat roller in the parts where the C-shaped cores are not present to generate an excessive fixing (hot offset) in the parts.

As compared therewith, since the temperature of the heat roller in the parts where the C-shaped cores are not present is relatively low, fixing characteristics are insufficient. Accordingly, such inconveniences as uneven fixing characteristics and uneven brightness arise in the parts where the C-shaped cores are present and the parts where the C-shaped cores are not present.

SUMMARY OF THE INVENTION

To overcome the above-described problems, C-shaped cores are arranged at an angle relative to the axial direction of a heat roller so that the areas of sections vertical to the axis of the heat roller are substantially the same at any part. According to the above-described structure, temperature difference in the axial direction of the heat roller is decreased and the generation of unevenness in fixing can be suppressed.

Further, assuming that the entire length of the magnetizing coil as length in the direction of the rotation axis of the heat generating member is L1 and the entire length of the heat generating member as length in the direction of the rotation axis thereof is L2, L1 is larger than L2 and the heat generating member is arranged so that its entire length is located within the entire length of the magnetizing coil.

Accordingly, since the heat generating member does not receive the influence of an unstable magnetic field generated in the end parts of the magnetizing coil, the heat generating member can uniformly generate heat without unevenness by the inductive heating unit.

BRIEF DESCRIPTION OF THE DRAWINGS

FIG. 8(*b*) is a sectional view showing another example of the fixing device as the image heater in the third embodiment of the present invention.

DETAILED DESCRIPTION OF THE PREFERRED EMBODIMENTS

Figure 1:
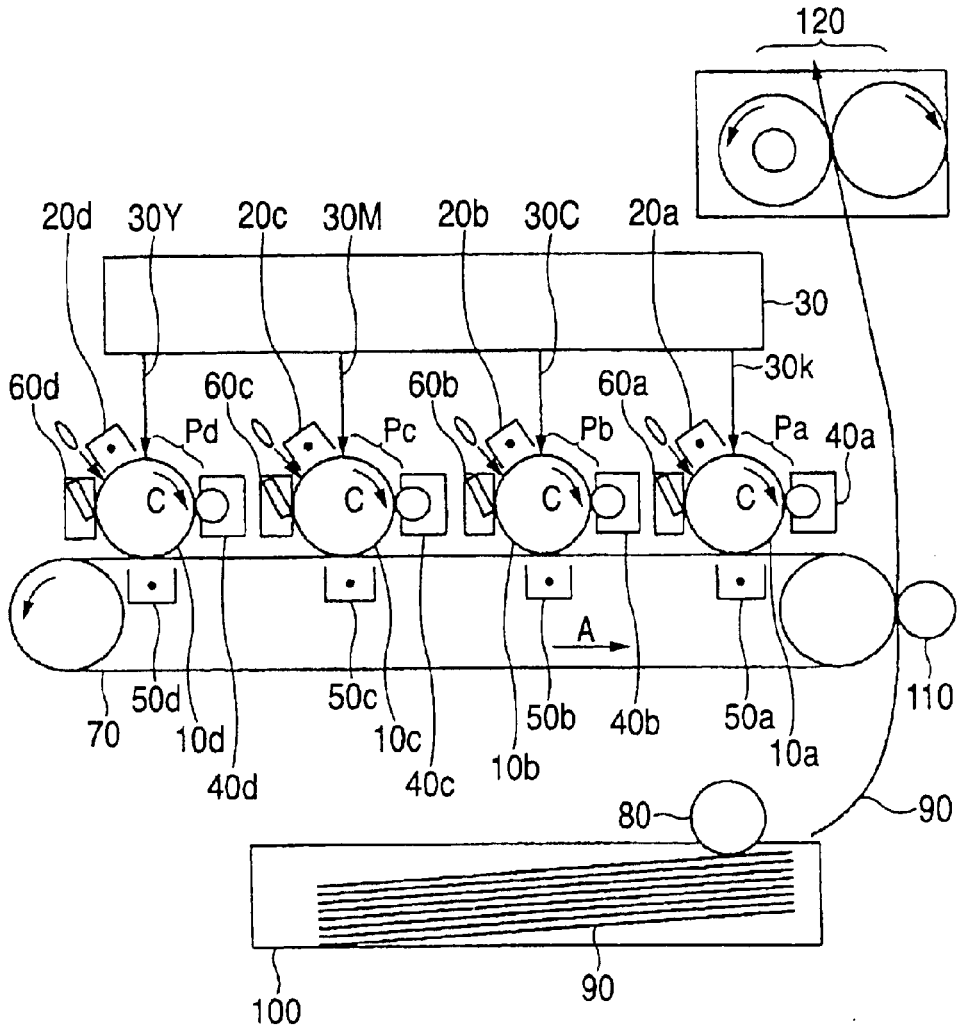
FIG. 1 is an explanatory view showing the structure of an image forming apparatus according to one embodiment of the present invention.

Now, embodiments of the present invention will be specifically described below by referring to the drawings.

(First Embodiment)

(Image Forming Apparatus)

Now, an outline of an image forming apparatus according to the present invention will be initially described. FIG. 1 is an explanatory view showing the structure of an image forming apparatus according to one embodiment of the present invention. The image forming apparatus described in this embodiment employs a tandem system. In the tandem system, a developing device is provided for each of four basic color toners that especially contribute to the color generation of a color image in the apparatus employing an electro-photographic system. Four color images are superposed on a transfer body and the superposed color images are simultaneously transferred to a sheet material. However, it is to be understood that the present invention is not limited to the image forming apparatus of the tandem system. The present invention may be applied to an image forming apparatus of any system irrespective of the number of developing devices and the presence or absence of an intermediate transfer body.

In FIG. 1, on the peripheries of photosensitive drums 10*a*, 10*b*, 10*c* and 10*d*, electrifying means 20*a*, 20*b*, 20*c* and 20*d* for electrifying the surfaces of the photosensitive drums 10*a*, 10*b*, 10*c* and 10*d* to prescribed potential, exposing means 30 for applying scanning lines 30K, 30C, 30M and 30Y of laser beams corresponding to image data of specific colors to the electrified photosensitive drums 10*a*, 10*b*, 10*c* and 10*d* to form electrostatic latent images, developing means 40*a*, 40*b*, 40*c* and 40*d* for visualizing the electrostatic latent images formed on the photosensitive drums 10*a*, 10*b*, 10*c* and 10*d*, transferring means 50*a*, 50*b*, 50*c* and 50*d* for transferring toner images visualized on the photosensitive drums 10*a*, 10*b*, 10*c* and 10*d* to an endless belt shaped intermediate transfer belt (intermediate transfer body) 70 and cleaning means 60*a*, 60*b*, 60*c* and 60*d* for removing toner remaining on the photosensitive drums 10*a*, 10*b*, 10*c* and 10*d* after the toner images are transferred to the intermediate transfer belt 70 from the photosensitive drums 10*a*, 10*b*, 10*c* and 10*d* are respectively arranged.

Here, the exposing means 30 is arranged to have a prescribed inclination relative to the photosensitive drums 10*a*, 10*b*, 10*c* and 10*d*. Further, the intermediate transfer belt 70 rotates in the direction shown by an arrow mark A in the drawing. In image forming stations Pa, Pb, Pc and Pd, a black image, a cyan image, a magenta image and a yellow image are respectively formed. Then, monochromatic images of respective colors formed on the photosensitive drums 10*a*, 10*b*, 10*c* and 10*d* are sequentially superposed on and transferred to the intermediate transfer belt 70 to form a full color image thereon.

In the lower part of the apparatus, a sheet feed cassette 100 in which sheet materials (recording medium) 90 such as printing sheets are accommodated is provided. Then, the sheet materials 90 are fed one sheet by one sheet to a sheet convey path from the sheet feed cassette 100 by a sheet feed roller 80.

On the sheet convey path, a sheet material transfer roller 110 which comes into contact with the outer peripheral surface of the intermediate transfer belt 70 over its prescribed amount to transfer the color image formed on the intermediate transfer belt 70 to the sheet material 90 is provided. Further, a fixing device 120 for fixing the color image transferred to the sheet material 90 under pressure and heat generated due to the rotation of rollers by sandwiching the sheet material in between the rollers is arranged.

In the image forming apparatus having the above-described structure, a latent image having image information of a black component color is firstly formed on the photosensitive drum 10*a* by the charging means 20*a* of the image forming station Pa and the exposing means 30. This latent image is visualized as a black toner image by the developing means 40*a* having black toner and transferred to the intermediate transfer belt 70 as the black toner image by the transferring means 50*a*.

While the black toner image is transferred to the intermediate transfer belt 70, a latent image of a cyan component color is formed in the image forming station Pb, and then, a cyan toner image composed of cyan toner is visualized by the developing means 40*b*. Then, the cyan toner image is transferred to the intermediate transfer belt 70 on which the transfer of the black toner image is completed in the previous image station Pa by the transferring means 50 of the image forming station Pb and superposed on the black toner image.

A magenta toner image and a yellow toner image are also formed in the same manner as described above. When the superposition of the toner images of four colors on the intermediate transfer belt 70 is completed, the toner images of four colors are simultaneously transferred to the sheet material 90 by the sheet material transfer roller 110. The sheet material 90 is fed from the sheet feed cassette 100 by the sheet feed roller 80. Then, the transferred toner images are heated and fixed to the sheet material 90 by the fixing device 120 and the full color image is formed on the sheet material 90.

(Fixing Device)

Figure 2:
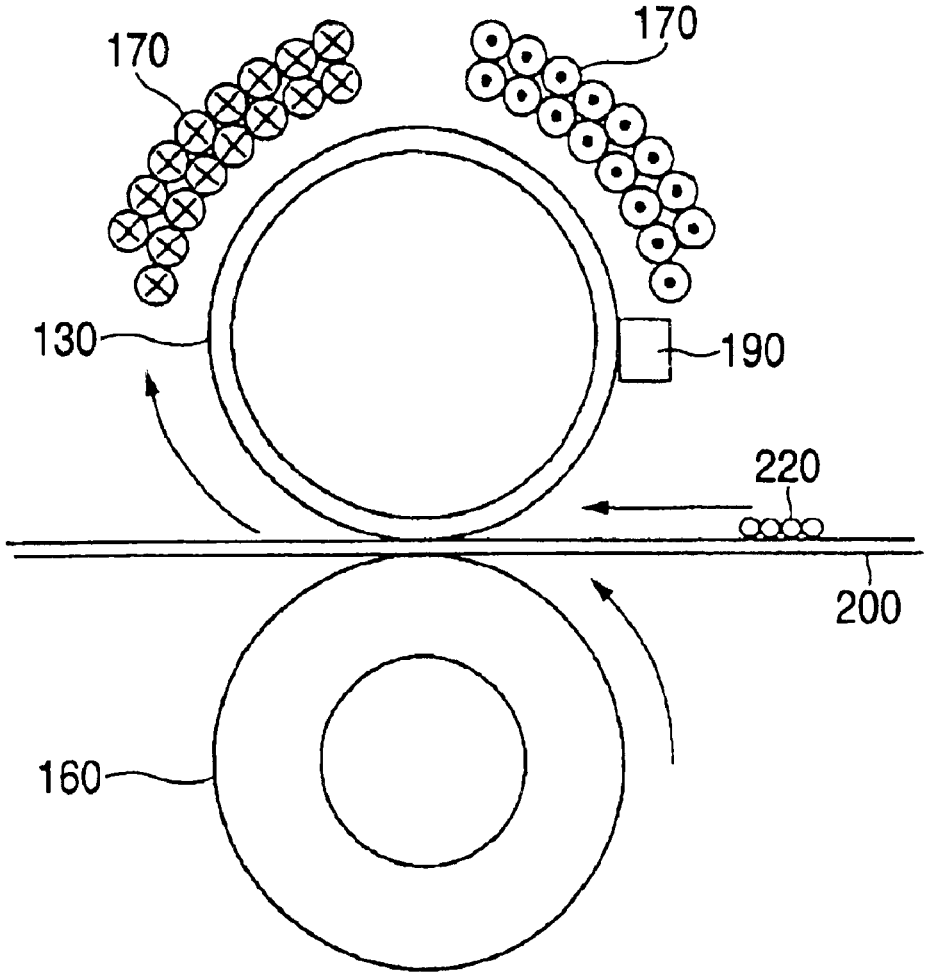
FIG. 2 is a sectional view showing a fixing device as an image heater in one embodiment of the present invention.
Figure 3:
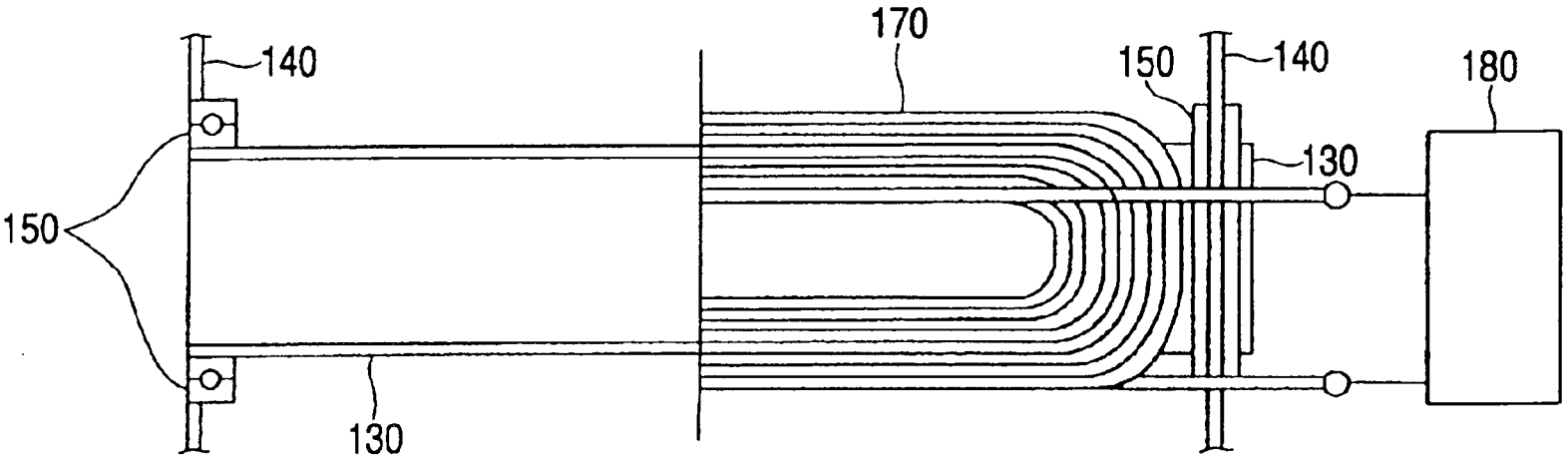
FIG. 3 is a partly fragmentary plan view showing a heat generating part of the fixing device as the image heater in the first embodiment of the present invention.

FIG. 2 is a sectional view showing a fixing device as an image heater according to one embodiment of the present invention. FIG. 3 is a plan view partly fragmentarily showing a heat generating part of the fixing device.

In FIGS. 2 and 3, reference numeral 130 designates a heat generating roller as a heat generating member. Reference numeral 140 designates support side plates made of steel plates plated with zinc. Reference numeral 150 designates bearings fixed to the support side plates 140 and supporting the heat generating roller 130 at its both ends so as to freely rotate. The heat generating roller 130 is driven to rotate by driving means of a device main body that is not illustrated. The heat generating roller 130 is made of a magnetic material composed of an alloy of iron, nickel and chromium and is adjusted so that its Curie point is 300° C. or higher. Further, the heat generating roller 130 is formed in the shape of a pipe having the thickness of 0.3 mm.

The surface of the heat roller 130 is coated with a mold releasing layer (not shown) made of a fluorine resin having the thickness of 20 $\mu$m to apply mold releasing characteristics thereto. As the mold releasing layer, a resin or rubber good in its mold releasing characteristics such as PTFE, PFA, FEP, silicone rubber, fluorine rubber, etc. may be independently used or mixed and the mixture is used. When the heat generating roller 130 is used for fixing a monochromatic image, only the mold releasing characteristics may be ensured. However, when the heat generating roller 130 is used for fixing a color image, elasticity is desirably applied to the heat generating roller. In that case, a thicker rubber layer further needs to be formed.

Reference numeral 160 is a pressure roller as pressing means. The pressure roller 160 is formed of silicone rubber having the hardness of JISA 65 degrees and made to come into contact with the heat generating roller 130 under the pressing force of 20 kgf to form a nip part. Then, under this state, the pressure roller 160 rotates together with the rotation of the heat generating roller 130. As materials of the pressure roller 160, heat resistant resins or rubber such as other fluorine rubber, fluorine resins, etc. may be employed. Further, in order to improve an abrasion resistance or the mold releasing characteristics, the surface of the pressure roller 160 is desirably independently coated with the resins such as PFA, PTFE, FEP, etc. or the rubber or the mixture thereof. Further, in order to prevent the radiation of heat, the pressure roller 160 is desirably composed of a material low in its thermal conductivity.

Reference numeral 170 designates a magnetizing coil as magnetizing means. This magnetizing coil 170 is formed in such a manner as described below. 60 copper wires having the outside diameter of 0.2 mm whose surfaces are insulated are bundled to form a bundle of wires and the bundle of wires is drawn in the direction of a rotation axis of the heat generating roller 130. The bundle of wires is wound along the direction of the circumference of the heat generating roller 130. The cross-sectional area of the bundle of wires including the insulating coat of the wires is about 7 $mm^2$.

The bundle of wires is arranged to allow the wires to mutually come into close contact along the direction of the circumference of the heat generating roller 130. Thus, the section of the magnetizing coil 170 vertical to the rotation axis of the heat generating roller 130 covers the upper half of the heat generating roller 130. The bundle of wires is wound twice and these bundles of wires are overlapped. In this case, the adjacent bundles of wires of the bundles of wires that extend from one end part to the other end part of the heat generating roller 130 come into close contact with each other. The adjacent bundles of wires of the bundles of wires that extend from the other end part to the one end part of the heat generating roller come into close contact with each other.

As for a sequence of winding of the bundles of wires which are drawn and wound in the direction of the rotation axis of the heat generating roller 130, the bundles of wires do not need to be wound sequentially from a part near a center of winding. The sequence of winding of the bundles of wires may be the changed halfway.

The magnetizing coil 170 has all the number of windings of 18. The bundles of wire are bonded to each other by adhesive agents on the surfaces thereof to maintain a form shown in FIGS. 2 and 3. The magnetizing coil 170 is opposed to the outer peripheral surface 130 with a space of about 2 mm. A range where the magnetizing coil 170 is opposed to the outer peripheral surface of the heat generating roller 130 is a wide range having an angle of about 180 degrees about the rotation axis of the heat generating roller 130.

To the magnetizing coil 170, ac current of 30 kHz is supplied from a magnetizing circuit 180 as a semi-resonance type inverter. The ac current supplied to the magnetizing coil 170 is controlled so that the surface of the heat generating roller 130 reaches 170° C. as prescribed fixing temperature in accordance with a temperature signal obtained by a temperature sensor 190 provided on the surface of the heat generating roller 130. The ac current supplied to the magnetizing coil 170 is also referred to as "coil current", hereinafter.

In this embodiment, a recording sheet of A4 size (width of 210 mm) is used as a recording sheet of maximum width. The length of the heat generating roller 130 in the direction of its rotation axis is set to 270 mm. The length of the magnetizing coil 170 in its outer peripheral part along the direction of the rotation axis of the heat generating roller 130 is set to 230 mm. The length of the magnetizing coil 170 in its inner peripheral part along the direction of the rotation axis of the heat generating roller 130 is set to 200 mm.

A recording sheet 200 which carries toner 220 on its surface as a material to be recorded is inserted into the fixing device formed as mentioned above from a direction shown by an arrow mark in FIG. 2. Thus, the toner 220 on the recording sheet 200 is fixed thereto.

In this embodiment, the magnetizing coil 170 causes the heat generating roller 130 to generate heat by an electromagnetic induction. Now, a mechanism thereof will be described by referring to FIG. 4.

Figure 4:
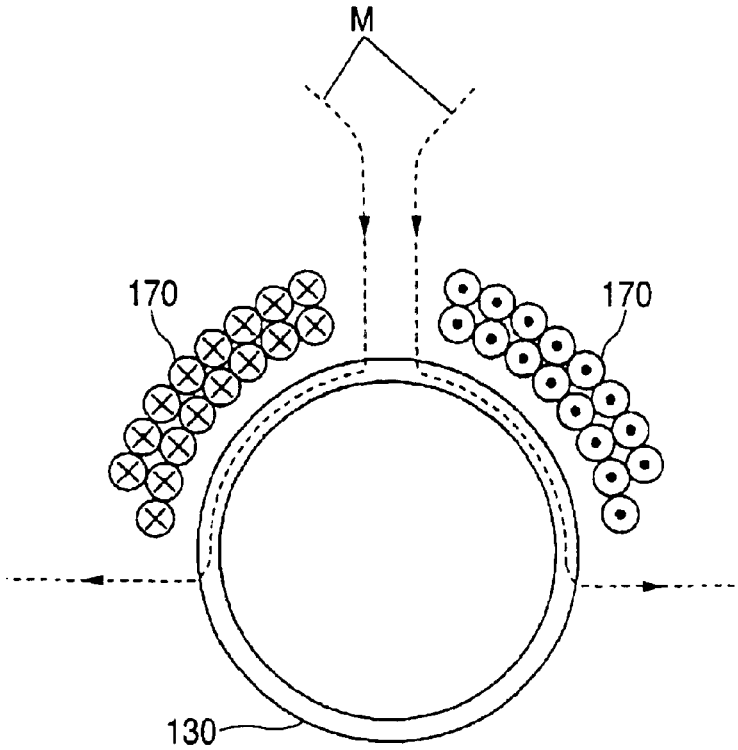
FIG. 4 is a sectional view showing the heat generating part of the fixing device as the image heater in the first embodiment of the present invention.

A magnetic flux generated by the magnetizing coil 170 through the a.c. current from the magnetizing circuit 180 (see FIG. 3) passes through the heat generating roller 130 in the direction of a circumference as shown by broken lines M in FIG. 4 due to the magnetism of the heat generating roller 130. The magnetic flux is repeatedly produced and quenched. Induced current generated in the heat generating roller 130 due to the change of the magnetic flux is allowed to substantially flow only to the surface of the heat generating roller 130 owing to a skin effect to generate Joule heat.

In this embodiment, the magnetizing coil 170 is formed in such a way as described below. The adjacent bundles of wires of the bundles of wires of the magnetizing coil 170 that extend from the one end part to the other end part of the heat generating roller 130 come into close contact with each other. Further, the adjacent bundles of wires of the bundles of wires that extend from the other end part to the one end part of the heat generating roller 130 come into close contact with each other. Therefore, the magnetic flux does not pass between the bundles of wires. Further, the bundles of wires do not exist in the central part of the magnetizing coil 170 and a space is provided so that the magnetic flux passes. Accordingly, as shown by the broken lines M in FIG. 4, the magnetic flux forms a large loop turning about the periphery of the magnetizing coil 170. Further, the magnetizing coil 170 is provided in the direction of the circumference of the heat generating roller 130. The magnetizing coil 170 is opposed to the heat generating roller 130 over a wide range of an angle of about 180 degrees on the rotation axis of the heat generating roller 130 at a center. Accordingly, the magnetic flux passes through the heat generating roller 130 in the direction of the circumference over the wide range of the heat generating roller 130. Thus, the heat generating roller 130 generates heat in the wide range, so that even when the coil current is small and the magnetic flux is less generated, prescribed electric power can be supplied to the heat generating roller 130.

As described above, since there is no magnetic flux which passes between the bundles of wires without passing through the heat generating roller 130, electromagnetic energy applied to the magnetizing coil 170 is transmitted to the heat generating roller 130 without leakage. Therefore, even when the coil current is small, the prescribed electric power can be efficiently supplied to the heat generating roller 130. Further, the bundles of wires are allowed to mutually come into close contact so that the magnetizing coil 170 can be made compact.

Further, since the bundles of wires of the magnetizing coil 170 are located in the vicinity of the heat generating roller 130, the magnetic flux generated by the coil current is efficiently transmitted to the heat generating roller 130. Then, eddy current generated in the heat generating roller 130 by the magnetic flux is allowed to flow so as to cancel the change of a magnetic field by the coil current. In this case, since the coil current is close to the eddy current generated in the heat generating roller 130, an effect of canceling the currents each other is high so that the magnetic field generated in a peripheral space by all the currents is suppressed.

There is no member for preventing the radiation of heat from the outer periphery of the magnetizing coil 170. Therefore, the insulating coats of the wires can be prevented from being molten due to the rise of temperature as a result of stored heat or the resistance value of the magnetizing coil 170 can be prevented from rising.

Figure 5:
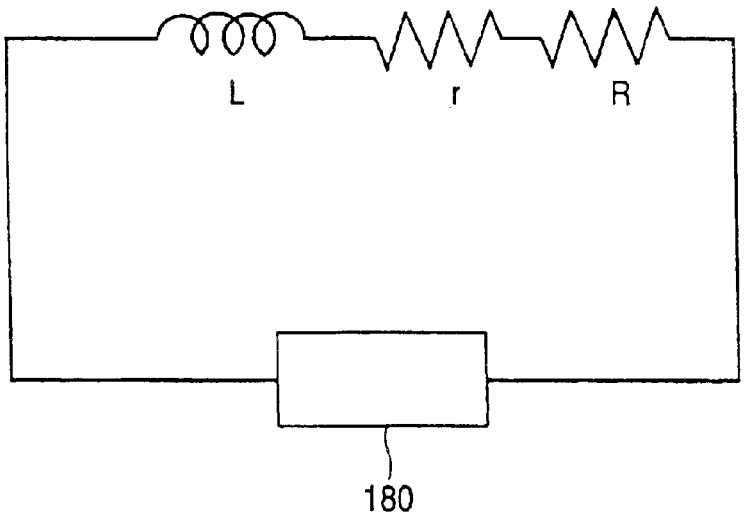
FIG. 5 is an equivalent circuit diagram of the heat generating part of the fixing device as the image heater in the first embodiment of the present invention.

FIG. 5 shows an equivalent circuit of the magnetizing coil and the heat generating roller while the magnetizing coil is opposed to the heat generating roller. In FIG. 5, r designates a resistance of the magnetizing coil 170 itself, R designates a resistance obtained by electromagnetically coupling the magnetizing coil 170 opposed to the heat generating roller 130 to the heat generating roller 130 and L designates an impedance of the entire part of the circuit. r is obtained in such a manner that the magnetizing coil 170 is removed from the heat generating roller 130 and the electric resistance of the magnetizing coil 170 as a simple substance is measured under prescribed angular frequency ω by an LCR meter. R is obtained as a value got by removing r from the electric resistance while the magnetizing coil 170 is opposed to the heat generating roller 130. L is substantially equal to the inductance of the magnetizing coil 170 as a simple substance. When current I is supplied to the circuit, the product of square of the current I and the resistance value is consumed as effective electric power to generate heat. The magnetizing coil 170 generates heat by the electric power consumed by r and the heat generating roller 130 generates heat by the electric power consumed by R. When electric power supplied to the heat generating roller 130 is W, this relation is represented by the following (mathematical expression 1).

$$W=(R+r)\times I^2 \quad \text{(mathematical expression 1)}$$

Further, when voltage applied to the magnetizing coil 170 is V, a relation represented by the following (mathematical expression 2) is established.

$$I=V/\{(R+r)^2+(\omega L)^2\} \quad \text{(mathematical expression 2)}$$

As can be understood from the above-described (mathematical expression 2), when L and R are excessively large, adequate current I cannot be obtained under prescribed voltage V. Accordingly, as can be understood from the above-described (mathematical expression 1), supplied electric power W is insufficient and a sufficient quantity of heat generation cannot be obtained. Conversely, when R is excessively small, even when the current I flows, effective electric power is not consumed and a sufficient quantity of heat generation cannot be obtained. Further, when L is excessively small, the magnetizing circuit 180 as the semi-resonance type inverter does not satisfactorily operate. When the frequency of ac current supplied to the magnetizing coil 170 from the magnetizing circuit 180 is located within a range of 25 kHz to 50 kHz, R may be 0.5Ω or higher and 5Ω or lower and L may be 10 μH or higher and 50 μH or lower. In this case, the magnetizing circuit 180 is formed of a circuit element having withstand current and withstand voltage which are not extremely high to obtain adequate supplied electric power and an adequate quantity of heat generation. Further, R and L are located within the above-described ranges. In this case, even when the specification of the magnetizing coil 170 such as the number of windings of the magnetizing coil 170, the space between the magnetizing coil 170 and the heat generating roller 130 or the like is changed, similar effects can be obtained.

In this embodiment, as described above, the bundle of wires of the magnetizing coil 170 is formed by binding 60 wires whose outside diameter is 0.2 mm. The structure of the bundle of wires is not necessarily limited thereto. The bundle of wires is desirably formed by binding wires having the number of 50 to 200 whose outside diameter ranges from 0.1 mm to 0.3 mm. When the outside diameter of the wire is smaller than 0.1 mm, the burnout of the wires of the magnetizing coil due to a mechanical load may be possibly caused. On the other hand, when the outside diameter of the wire exceeds 0.3 mm, an electric resistance (r in FIG. 5) to the ac current of high frequency becomes large and a quantity of heat generation in the magnetizing coil 170 extremely increases. Further, when the number of wires forming the bundle of wires is 50 or smaller, the electric resistance becomes large due to a small cross-sectional area and the heat generation of the magnetizing coil 170 is excessively increased. When the number of wires forming the bundle of wires is 200 or larger, it is difficult to wind the magnetizing coil 170 to an arbitrary form, because the bundle of wires is thick. Further, it is difficult to obtain the prescribed number of windings in a prescribed space. The outside diameter of the bundle of wires is substantially 5 mm or smaller, so that these conditions may be satisfied. Thus, since the number of windings of the magnetizing coil 170 can be increased in a narrow space, necessary electric power can be supplied to the heat generating roller 130 while the magnetizing coil 170 is miniaturized.

The bundles of wires of the magnetizing coil 170 to be wound may be formed to be partly spaced from each other, however, may substantially come into close contact with each other with good efficiency. Further, a way of overlapping the bundles of wires of the magnetizing coil 170 to be wound may be partly changed. When the height of the magnetizing coil 170 is low, more electric power can be supplied to the heat generating roller 130 under smaller current. As the shape of the magnetizing coil 170, the width of the magnetizing coil in which the bundles of wires are wound and arranged (length in the direction of the circumference) may be preferably larger than the height of the magnetizing coil 170 (the thickness of the laminated bundles of wires).

The length of the magnetizing coil 170 in the direction of the rotation axis of the heat generating roller 130 is larger than the length of the heat generating roller 130. In this case, the magnetic flux passes through the electric conductive members such as the side plates 140 at the end parts of the heat generating roller 130. Therefore, peripheral component members generate heat, so that a rate of transmission of electromagnetic energy to the heat generating roller 130 is reduced. In this embodiment, the length of the heat generating roller 130 is larger than the length of the magnetizing coil 170 in the direction of the rotation axis of the heat generating roller 130. Therefore, the magnetic flux generated by the coil current does not reach the peripheral component members such as the side plates 140 and substantially all the coil current reaches the heat generating roller 130. Thus, the electromagnetic energy applied to the magnetizing coil 170 can be efficiently transmitted to the heat generating roller 130. Especially, when the magnetic flux passes in the direction of the rotation axis from the end face of the heat generating roller 130, eddy current density on the end face of the heat generating roller 130 becomes high. In this case, a problem arises that the heat generation on the end face of the heat generating roller 130 is excessively increased.

As described above, according to this embodiment, the inner peripheral part of the magnetizing coil 170, the recording sheet having a maximum width, the outer peripheral part of the magnetizing coil 170 and the heat generating roller 130 may be arranged in order in view of smaller length in the direction of the rotation axis of the heat generating roller 130. The magnetizing coil 170 is wound in parallel with the direction of the rotation axis of the heat generating roller 130 and equally and uniformly wound in the direction of the rotation axis in a part where the recording sheet 200 passes. Therefore, the heat generating distribution of the heat generating roller 130 in the part where the recording sheet 200 passes can be made uniform. As a result, a temperature distribution in the fixing part can be made uniform to obtain a stable fixing operation.

(Second Embodiment)

Figure 6:
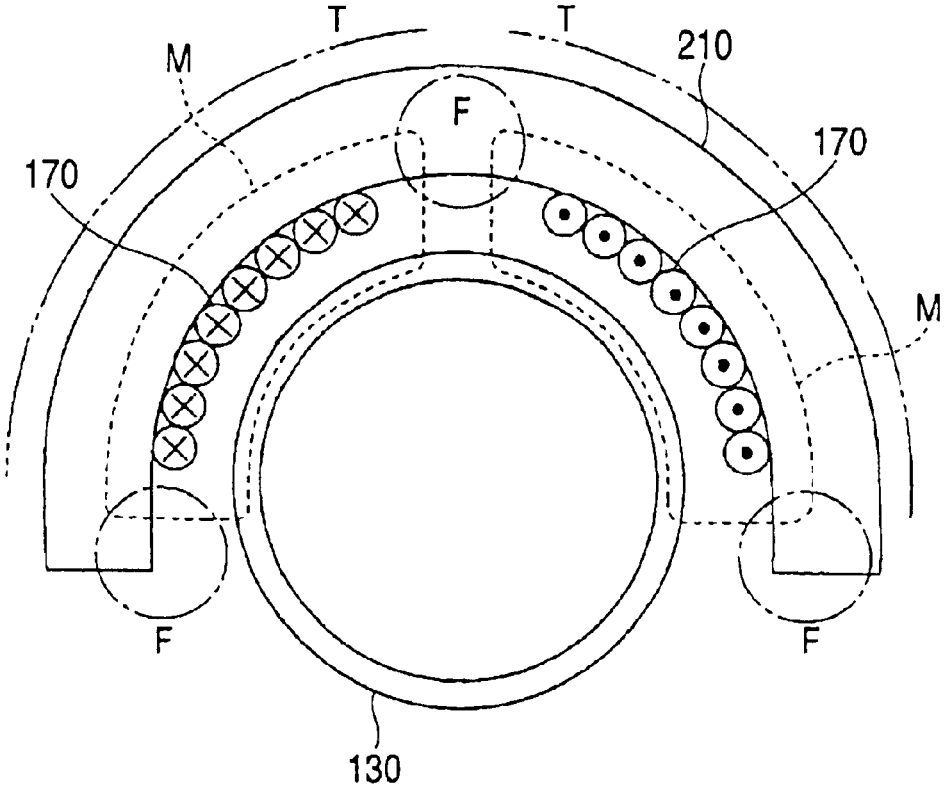
FIG. 6 is a sectional view showing a heat generating part of a fixing device as an image heater in a second embodiment of the present invention.
Figure 7:
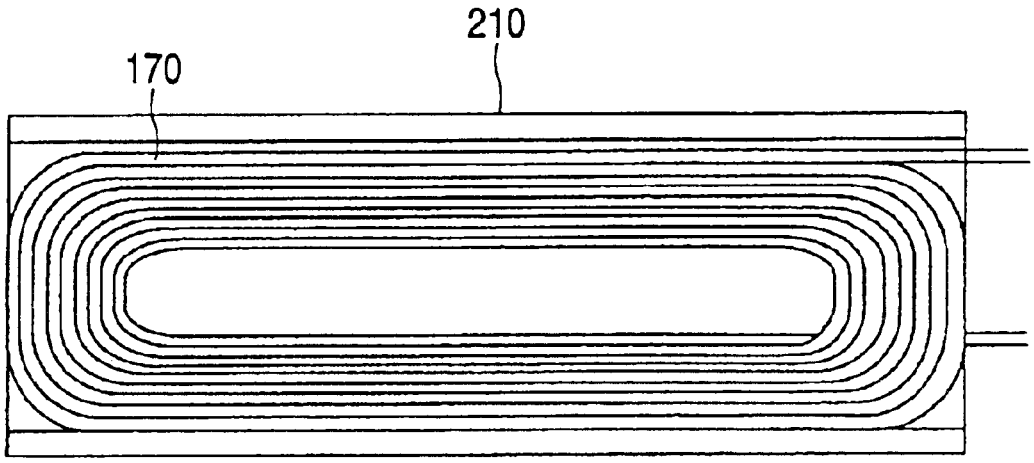
FIG. 7 is a bottom view showing the heat generating part except a heat generating roller of the fixing device as the image heater in the second embodiment of the present invention.

FIG. 6 is a sectional view showing a heat generating part of a fixing device as an image heater in a second embodiment of the present invention. FIG. 7 is a bottom view showing the heat generating part of the fixing device with a heat generating roller removed. Members having the same functions as those of the first embodiment are designated by the same reference numerals and the explanation thereof is omitted.

The second embodiment is different from the first embodiment in the following respects. That is, in the second embodiment, a bundle of wires is not wound twice and wound along the direction of the circumference of a heat generating roller 130 and a back surface core 210 is provided on the back surface of a magnetizing coil 170.

The back surface core 210 covers a range where the magnetizing coil 170 does not exist and an "opposed part F" opposed to the heat generating roller 130 without interposing the magnetizing coil 170 between them is provided. Parts of the back surface core 210 opposed to the heat generating roller 130 through the magnetizing coil 170 are called "magnetic permeable parts T", hereinafter. The section of the back surface core 210 has a form obtained by cutting a cylinder at an angle of 180 degrees in the axial direction.

With such a structure, a magnetic path can have a length larger than that of a conventional core. Further, an air part low in its magnetic permeability which a magnetic flux generated by coil current passes is only a narrow gap part between the heat generating roller 130 and the back surface core 210. Therefore, the inductance of the magnetizing coil 170 is increased and the magnetic flux generated by the coil current is substantially completely guided to the heat generating roller 130. As a result, the electromagnetic coupling between the heat generating roller 130 and the magnetizing coil 170 is more improved. R in the equivalent circuit shown in FIG. 5 is further increased. Thus, more electric power can be supplied to the heat generating roller 130 under the same coil current.

As shown by broken lines M in FIG. 6, the magnetic flux introduced to the heat generating roller 130 from the back surface core 210 passes through the opposed part F. The length of the opposed part F along the direction of the rotation axis of the heat generating roller 130 is the same as the length of the back surface core 210 along the direction of the rotation axis of the heat generating roller 130. The length of the opposed part F along the direction of the rotation axis is longer than the width of a recording sheet. Accordingly, the magnetic flux is uniformly incident on a part where the recording sheet passes from the opposed part F. Thus, a range of the heat generating roller 130 necessary for fixing can be uniformly heated.

As a material of the back surface core 210, for instance, ferrite having relative magnetic permeability of 1000 to 3000, saturation magnetic flux density of 200 to 300 mT and volume resistivity of 1 to 10 Ω·m is employed. Further, as the material of the back surface core 210, a material other than ferrite having high magnetic permeability and resistivity such a permalloy may be used.

The section of the back surface core 210 has a form obtained by cutting a cylinder having, for instance, the outside diameter of 36 mm and the thickness of 5 mm substantially at an angle of 90 degrees in the axial direction. Accordingly, the cross-sectional area of the back surface core 210 is 243 $mm^2$. The cross-sectional area of the magnetizing coil 170 is 126 $mm^2$ in accordance with 7 $mm^2 \times 9$ windings×2.

The heat generating roller 130 is formed in the shape of a pipe having, for instance, the outside diameter of 20 mm and the thickness of 0.3 mm. Accordingly, the cross-sectional area of a plane of the heat generating roller 130 vertical to the rotation axis therein is about 295 $mm^2$. Thus, the cross-sectional area of the magnetizing coil 170 including the back surface core 210 is larger than the cross-sectional area of the plane of the heat generating roller 130 vertical to the rotation axis therein. A space between the back surface core 210 and the heat generating roller 130 is, for instance, 5.5 mm.

In this embodiment, a recording sheet of size of A4 (width of 210 mm) is used as a recording sheet of maximum width. The length of the heat generating roller 130 in the direction of its rotation axis is set to 240 mm. The length of the magnetizing coil 170 wound in an outer peripheral part along the direction of the rotation axis of the heat generating roller 130 is set to 200 mm. The length of the magnetizing coil 170 wound in an inner peripheral part along the direction of the rotation axis of the heat generating roller 130 is set to 170 mm. The length of the back surface core 210 along the direction of the rotation axis of the heat generating roller 130 is set to 220 mm. Bearings 150 (see FIG. 3) as support members of the heat generating roller 130 are made of steel as a magnetic material. A space between the bearings 150 and the back surface core 210 is 10 mm and larger than the space between the back surface core 210 and the heat generating roller 130.

Other structures are the same as those of the first embodiment.

The operation of the fixing device formed as mentioned above will be described below.

The back surface core 210 is provided to increase the inductance of the magnetizing coil 170. Accordingly, the electromagnetic coupling between the magnetizing coil 170 and the heat generating roller 130 is improved and R in the equivalent circuit shown in FIG. 5 is increased. Therefore, much electric power can be supplied to the heat generating roller 130 under the same coil current. Accordingly, an inexpensive magnetizing circuit 180 (see FIG. 3) having low withstand current and withstand voltage is used to realize a fixing device having short warm-up time.

As shown by the broken lines M in FIG. 6, all the magnetic flux in the back surface side of the magnetizing coil 170 passes through the back surface core 210, the magnetic flux can be prevented from leaking rearward. As a result, heat generation due to the electromagnetic induction of peripheral electric conductive members can be prevented and the radiation of unnecessary electromagnetic wave can be prevented.

Since the winding bundles of wires are not overlapped, all the bundles of wires of the magnetizing coil 170 are located in the vicinity of the heat generating roller 130. Therefore, the magnetic flux generated by the coil current is more efficiently transmitted to the heat generating roller 130.

In this embodiment, since the magnetizing coil 170 or the back surface core 210 are arranged outside the heat generating roller 130 (heat generating part), the magnetizing coil 170 or the like can be prevented from receiving the influence of the temperature of the heat generating part to raise temperature. Thus, the quantity of generated heat can be maintained in a stable way. Especially, the magnetizing coil 170 and the back surface core 210 having a cross-sectional area larger than the cross-sectional of the plane of the heat generating roller 130 vertical to the rotation axis therein are used. Accordingly, the heat generating roller 130 low in its thermal capacity, the magnetizing coil 170 having the large number of windings and suitable amount of ferrite (back surface core 210) can be combined together and the combination can be used. Therefore, while the thermal capacity of the fixing device is suppressed, much electric power can be supplied to the heat generating roller 130 under prescribed coil current.

In this embodiment, as described above, the inner peripheral part of the magnetizing coil 170, the outer peripheral part of the magnetizing coil 170, the recording sheet of the maximum width, the back surface core 210 and the heat generating roller 130 may be arranged in order of smaller length in the direction of the rotation axis of the heat generating roller 130. As described above, the length of the magnetizing coil 170 in the outer peripheral part along the direction of the rotation axis of the heat generating roller 130 is smaller than the width of the recording sheet of the maximum width. The length of the back surface core 210 along the direction of the rotation axis of the heat generating roller 130 is larger than the width of the recording sheet of the maximum width. Therefore, even when the magnetizing coil 170 is slightly unevenly wound, a magnetic field reaching the heat generating roller 130 from the magnetizing coil 170 can be made uniform in the direction of the rotation axis. Accordingly, the heat generating distribution of the heat generating roller 130 in the part where the recording sheet passes can be made uniform. Thus, a temperature distribution in the fixing part can be made uniform so that a stable fixing operation can be obtained. Further, while the heat generating distribution of the heat generating roller 130 is made uniform, the length of the heat generating roller 130 in the direction of its rotation axis thereof and the length of the magnetizing coil 170 along the direction of the rotation axis of the heat generating roller 130 can be reduced. Accordingly, the device can be made compact and a cost can be reduced at the same time. Further, the length of the back surface core 210 along the direction of the rotation axis of the heat generating roller 130 is shorter than the length of the heat generating roller 130 in the rotation axis thereof. Therefore, eddy current density in the end faces of the heat generating roller 130 can be prevented from being high, so that the heat generation in the end faces of the heat generating roller 130 is not excessively increased.

Further, as described above, as the bearings 150 (see FIG. 3) serving as the support members of the heat generating roller 130, steel ordinarily having a magnetism is employed to ensure a mechanical strength. Consequently, the magnetic flux generated by the coil current is easily absorbed by the bearings 150. When the magnetic flux passes through the bearings 150, heat is generated. Thus, a rate of transmission of electromagnetic energy to the heat generating roller 130 is reduced and the temperature of the bearings 150 rises to shorten the life thereof. In this embodiment, as described above, since the space between the bearing 150 and the end face of the back surface core 210 is set to be larger than the space between the back surface core 210 and the heat generating roller 130 opposed thereto. Accordingly, the magnetic flux passing through the back surface core 210 is not guided to the bearings 150 and substantially passes through the heat generating roller 130. Thus, the electromagnetic energy applied to the magnetizing coil 170 can be efficiently transmitted to the heat generating roller 130 and the heat generation of the bearings 150 can be prevented.

The space between the bearings 150 and the back surface core 210 (10 mm in this embodiment) may be larger than the space between the back surface core 210 and the heat generating roller 130 opposed thereto (5.5 mm in this embodiment). The former is desirably larger two times or more than the latter.

Further, since the thickness of the back surface core 210 is uniform, heat is not locally stored in the back surface core 210. There is no member for preventing the radiation of heat from the outer periphery of the back surface core 210. Therefore, the saturation magnetic flux density of the back surface core 210 can be prevented from falling due to the rise of temperature owing to the stored heat to suddenly decrease a magnetic permeability as a whole. Thus, the heat generating roller 130 can be maintained at prescribed temperature in a stable way for a long time.

(Third Embodiment)

Now, a fixing device as an image heater according to a third embodiment will be described in detail.

Figure 8:
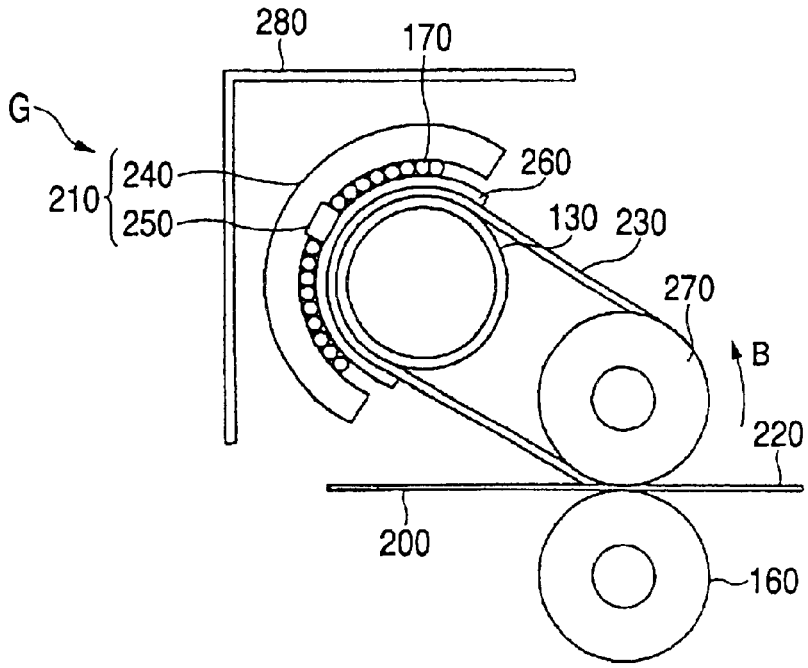
FIG. 8(*a*) is a sectional view showing a fixing device as an image heater in a third embodiment of the present invention.
Figure 8:
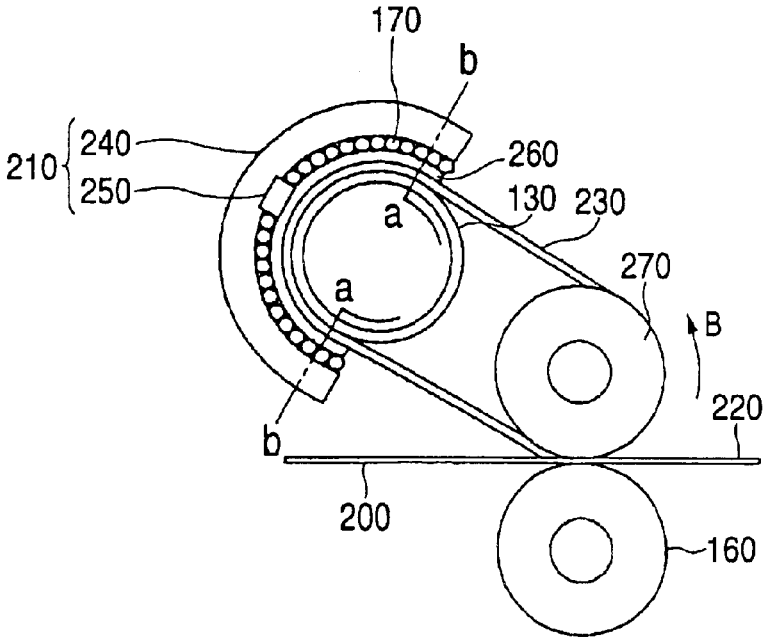

In FIG. 8(*a*), a thin fixing belt 230 is an endless belt whose base material is composed of polyimide having the diameter of 50 mm and the thickness of 100 $\mu$m. The surface of the fixing belt 230 is coated with a mold releasing layer (not shown) made of fluorine resin and having the thickness of 20 $\mu$m to apply mold releasing characteristics thereto. As a material of the base material, extremely thin metal such as nickel produced by electro-casting may be used as well as a polyimide resin, a fluorine resin, etc. having a heat resistance. As the mold releasing layer, a resin or rubber good in its mold releasing characteristics such as PTFE, PFA, FEP, silicone rubber, fluorine rubber, etc. may be independently used or mixed and the mixture may be used. When the fixing belt 230 is used for fixing a monochromatic image, only the mold releasing characteristics may be ensured. However, when the fixing belt 230 is used for fixing a color image, elasticity is desirably applied thereto. In that case, a thick rubber layer further needs to be formed.

A magnetizing coil 170 as magnetizing means is formed in such a manner as described below. 60 copper wires with the outside diameter of 0.2 mm whose surfaces are insulated are bundled to form a bundle of wires and the bundle of wires is drawn in the direction of a rotation axis of a heat generating roller 130. The bundle of wires is wound along the direction of the circumference of the heat generating roller 130. The cross-sectional area of the bundle of wires including the insulating coat of the wires is about 7 $mm^2$.

As shown in FIGS. 8(*a*) to 11, the magnetizing coil 170 has a sectional shape so as to cover the fixing belt 230 wound on the heat generating roller 130. The magnetizing width of the magnetizing coil 170 in the direction of movement of the fixing belt 230 is a range (winding range) in which the fixing belt 230 comes into contact with the heat generating roller 130 or smaller. When a part of the heat generating roller 130 in which heat is not taken away by the fixing belt 230 generates heat, the temperature of the heat generating roller 130 inconveniently readily rises exceeding the heat resistant temperature of a material of the fixing belt 230. However, in the structure of this embodiment, only a range of the heat generating roller 130 where the heat generating roller 130 comes into contact with the fixing belt 230 generates heat, so that the temperature of the heat generating roller 130 can be prevented from abnormally rising. Further, the bundles of wires are overlapped only at both the end parts of the magnetizing coil 170 (at both end parts of the heat generating roller 130 in the direction of the rotation axis thereof). The bundle of wires is wound 9 times under a state that the bundles of wires come into close contact along the direction of the circumference of the heat generating roller 130. Both the end parts of the magnetizing coil 170 in the direction of the rotation axis of the heat generating roller 130 swell under a state that the bundles of wires are overlapped in two rows. That is, the magnetizing coil 170 is formed in the shape of a saddle as a whole. Therefore, a wider range of the heat generating roller 130 in the direction of the rotation axis thereof can be uniformly heated. Since the bundles of wires overlapped at both the end parts of the magnetizing coil 170 are more spaced from the heat generating roller 130. Accordingly, eddy current does not concentrate on these parts, so that the temperature of these parts is not partly excessively high.

A back surface core 210 comprises a C-shaped core 240 and a central core 250. The C-shaped core 240 has the width of 10 mm and six C-shaped cores are arranged at intervals of 25 mm in the direction of the rotation axis of the heat generating roller 130. Thus, a magnetic flux leaking outside can be captured. The central core 250 is located at the center of windings of the magnetizing coil 170 and protrudes relative to the C-shaped core 240. That is, the central core 250 forms a part N (see FIG. 12) near to the heat generating roller 130 among the opposed parts F of the back surface core 210. The cross-sectional area of the central core 250 is 3 mm×10 mm.

Further, the central core 250 may be divided into several pieces in the direction of the rotation axis of the heat generating roller 130 so as to be easily formed from ferrite. Still further, the central core 250 may be combined integrally with the C-shaped cores 240. Furthermore, the central core 250 may be combined integrally with the C-shaped cores 240 and divided into several pieces in the direction of the rotation axis of the heat generating roller 130.

Figure 11:
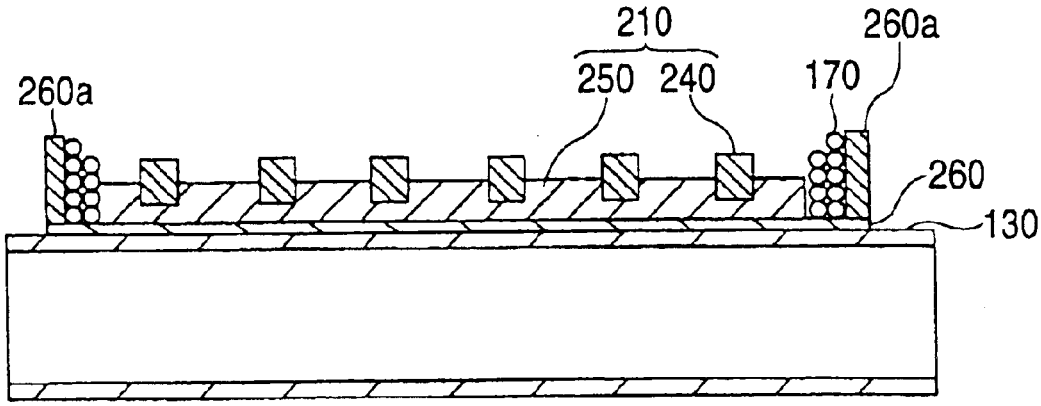
FIG. 11 is a sectional view showing the heat generating part in a plane including a rotation axis of a heat generating roller and a center of magnetizing coil in the fixing device as the image heater in the third embodiment of the present invention.

Reference numeral 260 designates a heat insulating member made of a PEEK material or a resin such as PPS having high heat resistance temperature and the thickness of 1 mm. At the end parts of the heat insulating member 260, both end holding parts 260*a* are provided for holding the swelling parts at both the ends of the magnetizing coil 170 in the direction of the rotation axis of the heat generating roller 130 (see FIG. 11). Thus, the swells at both the ends of the magnetizing coil 170 can be prevented from collapsing and the outer positions of the magnetizing coil 170 are regulated.

A material of the back surface core 210 is the same as that of the second embodiment. The sectional form of the back surface core 210 in a section including the C-shaped core 240 except the central core 250 and the form of the heat generating roller 130 are also the same as those of the second embodiment. Accordingly, the third embodiment is also the same as the second embodiment in view of the point described below. That is, the cross-sectional area of the magnetizing coil 170 including the back surface core 210 is larger than the cross-sectional area of a plane of the heat generating roller 130 vertical to the rotation axis therein.

An a.c. current supplied to the magnetizing coil 170 from a magnetizing circuit 180 (see FIG. 3) is the same as that of the first embodiment. The ac current supplied to the magnetizing coil 170 is controlled so that the surface of the fixing belt 230 has prescribed fixing temperature of 190° C. in accordance with a temperature signal obtained by a temperature sensor provided on the surface of the fixing belt 230.

As shown in FIG. 8(*a*), the fixing belt 230 is extended between a fixing roller 270 having low thermal conductivity and the diameter of 20 mm and the heat generating roller 130 having the diameter of 20 mm under prescribed tension. The fixing roller can rotate to move in the direction shown by an arrow mark B. The fixing roller 270 is made of silicone rubber as a foaming body whose surface has an elasticity of low hardness (JISA 300 degrees). At both the ends of the heat generating roller 130, ribs (not shown) are provided for preventing the zigzag movement of the fixing belt 230. Further, a pressure roller 160 as pressing means is pressed to the fixing roller 270 under pressure through the fixing belt 230. Thus, a nip part is formed.

In this embodiment, a recording sheet of size of A4 (having the width of 210 mm) is used as a recording sheet of maximum width. The width of the fixing belt is set to 230 mm and the length of the heat generating roller 130 in the direction of its rotation axis is set to 260 mm. The length of the back surface core 210 between outermost ends in the direction of the rotation axis of the heat generating roller 130 is set to 225 mm. The length of the magnetizing coil 170 wound in an outer peripheral part along the direction of the rotation axis of the heat generating roller 130 is set to 245 mm. The length of the heat insulating member 260 along the direction of the rotation axis of the heat generating roller 130 is set to 250 mm.

In this embodiment, the magnetizing coil 170, the back surface core 210 and the heat generating roller 130 are formed as described above to generate the heat of the heat generating roller 130 by the electromagnetic induction of the magnetizing coil 170. A mechanism thereof will be described below by referring to FIG. 12.

Figure 12:
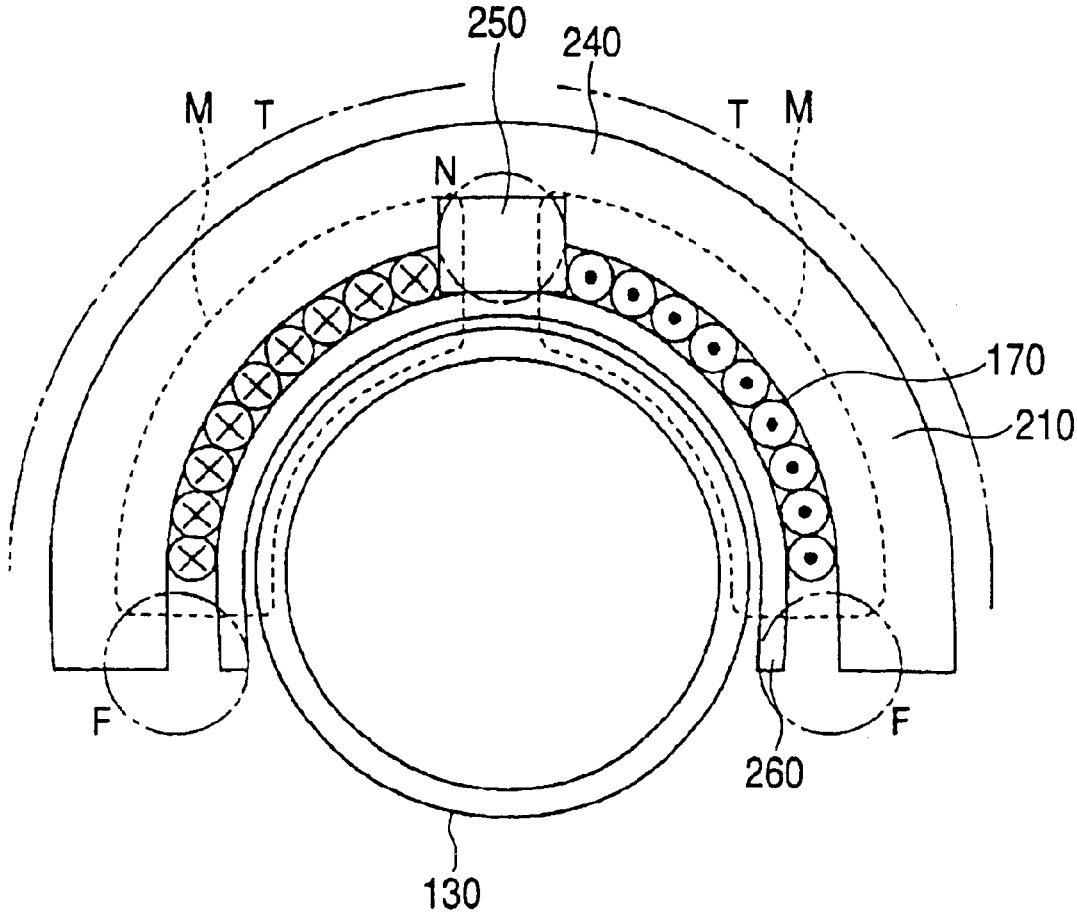
FIG. 12 is a sectional view showing the heat generating part of the fixing device as the image heater in the third embodiment of the present invention.

As shown in FIG. 12, a magnetic flux generated by coil current enters the heat generating roller 130 from the opposed parts F of the back surface core 210. In this case, the magnetic flux generated by the coil current passes through the heat generating roller 130 in the direction of its circumference as shown by broken lines M in the drawing due to magnetic characteristics of the heat generating roller 130. Then, this magnetic flux forms a large loop via a magnetic permeable part T from the central core 250 as the part N of the back surface core 210 near to the heat generating roller 130 to repeat its generation and extinction. Induced current caused due to the change of the magnetic flux generates Joule heat like the first embodiment.

Figure 9:
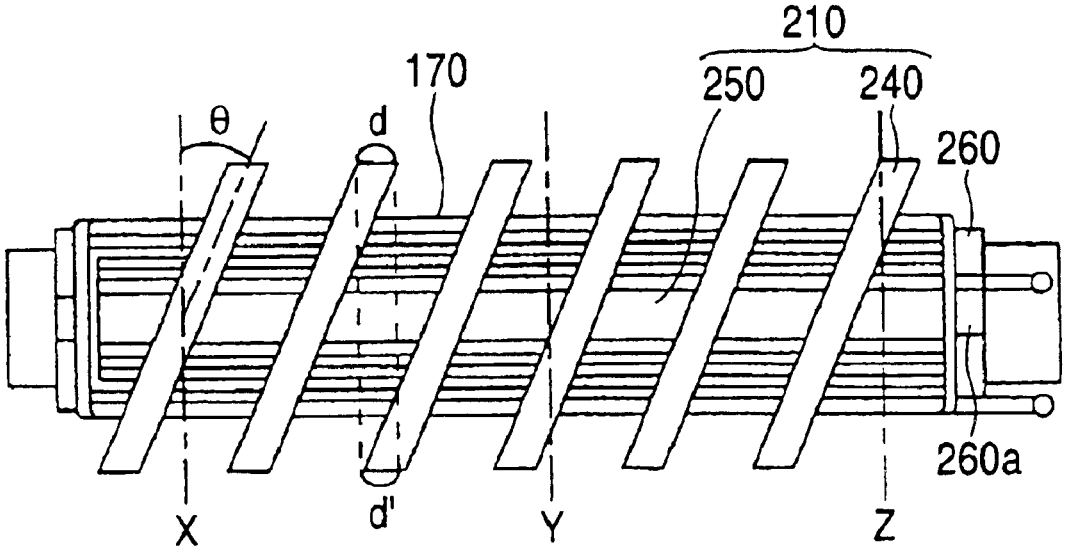
FIG. 9 is a projection drawing of a heat generating part viewed from a direction shown by an arrow mark G in FIG. 8(*a*).

In this embodiment, as shown in FIG. 9, a plurality of narrow C-shaped cores 240 are arranged at equal intervals in the direction of the rotation axis of the heat generating roller 130. However, only in this structure, the magnetic flux flowing in the direction of the circumference in the back surface of the magnetizing coil 170 concentrates on the parts of the C-shaped cores 240 and hardly flows to air between the adjacent C-shaped cores 240. Therefore, the magnetic flux entering the heat generating roller 130 tends to concentrate on the parts in which the C-shaped cores 240 are present. Consequently, the heat generated in the heat generating roller 130 is apt to be increased in parts opposed to the C-shaped cores 240. However, in this embodiment, the central core 250 forming the part N near to the heat generating roller at the center of windings of the magnetizing coil 170 is continuously provided in the direction of the rotation axis of the heat generating roller 130. Therefore, the magnetic flux entering the heat generating roller 130 from the opposed parts F to the C-shaped cores 240 is allowed to flow likewise in the direction of the rotation axis in the heat generating roller 130 to make a distribution uniform. Accordingly, unevenness in the quantity of generated heat of the heat generating roller 130 is mitigated.

An operation for guiding the magnetic flux of the magnetic permeable part T from the opposed part to the C-shaped core 240 to another opposed part F is not directly related to the incidence distribution of the magnetic flux on the heat generating roller 130. Therefore, the magnetic permeable part T is very effectively divided from the opposed parts F to optimize the form of the back surface core 210. The magnetic permeable part T does not need to be uniform in the axial direction and the opposed parts F may be made uniform in the axial direction as much as possible.

Since the central core 250 protrudes relative to the C-shaped cores 240 to provide the part N near to the heat generating roller 130, a magnetic path can be composed of more ferrite. Accordingly, a part of air low in its magnetic permeability which the magnetic flux generated by the coil current passes is located only in a narrow space part between the heat generating roller 130 and the back surface core 210. Therefore, since the inductance of the magnetizing coil 170 is more increased and the magnetic flux generated by the coil current is more guided to the heat generating roller 130, the electromagnetic coupling of the heat generating roller 130 to the magnetizing coil 170 is improved. Thus, more electric power can be supplied to the heat generating roller 130 under the same current. Especially, the magnetic flux generated by the coil current necessarily passes the center of windings of the magnetizing coil 170. Accordingly, the part N composed of the central core 250 near to the heat generating roller 130 which is continuous in the direction of the rotation axis of the heat generating roller 130 is provided in this part. Thus, the magnetic flux generated by the coil current can be efficiently guided to the heat generating roller 130.

Further, in this embodiment, as shown in FIG. 9, each C-shaped core 240 is formed at a prescribed angle of θ relative to the axial direction or the radial direction of the heat generating roller 130. When the C-shaped core has a form with an angle as described above, the magnetic flux generated by the magnetizing coil 170 passes through the heat generating roller 130 along the C-shaped cores 240 in the direction of an angle of θ relative to the axial direction or the radial direction of the heat generating roller 130. Therefore, when the heat generating roller 130 is rotated, Joule heat is evenly generated in the direction of the rotation axis in the heat generating roller 130. Accordingly, unevenness in the quantity of generated heat to the axial direction is more effectively cancelled.

Figure 10:
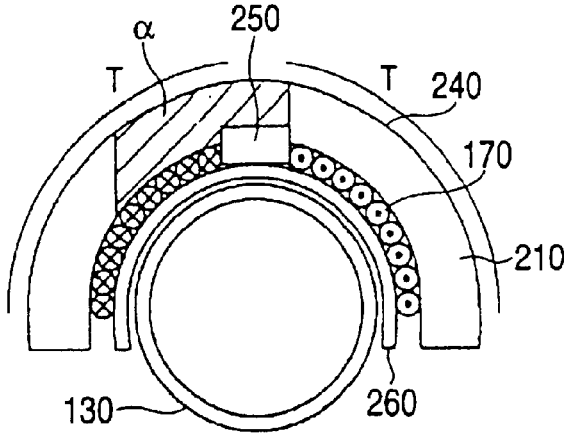
FIGS. 10(*a*) to 10(*c*) shows sectional views showing the heat generating part of the fixing device as the image heater in the third embodiment of the present invention.
Figure 10:
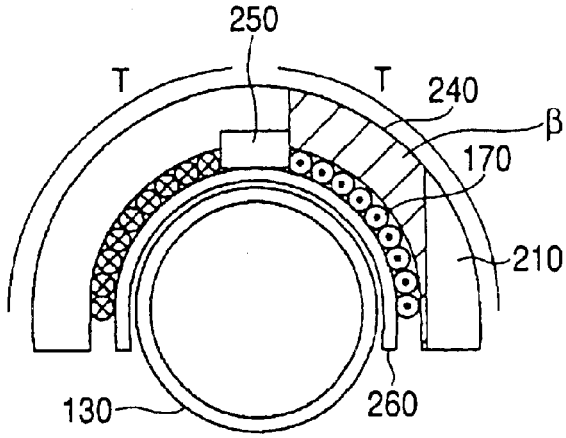
Figure 10:
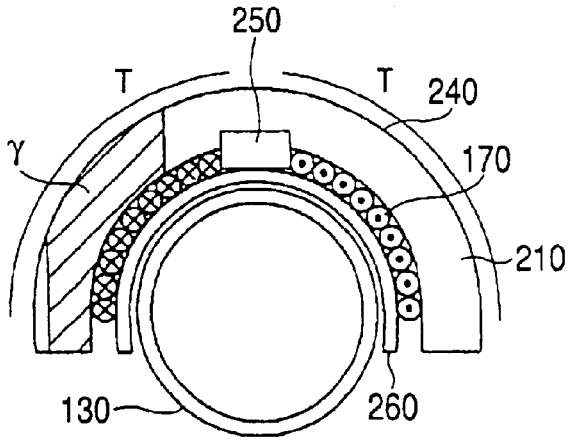

FIGS. 10(*a*) and 10(*b*) and 10(*c*) are sectional views obtained by cutting the C-shaped cores 240 and the heat generating roller 130 along dashed lines X, Y and Z in FIG. 9. Oblique line parts α,β and γ respectively show sections of the C-shaped core 240. For example, as shown in FIG. 9, when an angle of θ is selected so that a side d and a side d' of the C-shaped cores 240 adjacent to each other are located at positions where the sides d and d' are overlapped or correspond to each other in the direction (direction of circumference) perpendicular to the axial direction of the heat generating roller 130, the areas of the oblique line parts α, β and γ showing the sections obtained by cutting the C-shaped cores 240 are substantially the same.

As described above, when the angle θ of the C-shaped core 240 shown in FIG. 9 is selected so that even when the dashed lines X, Y and Z are selected at any positions, the cross-sectional areas are equal, unevenness in the quantity of generated heat in the axial direction of the heat generating roller 130 can be most effectively cancelled.

However, the angle θ is not limited to the above-described angle and various angles may be selected. Further, the angle θ of the C-shaped core 240 does not need to be the same for all the C-shaped cores 240. For example, when the angle θ of the C-shaped cores at end parts in the axial direction of the heat generating roller 130 is larger than the angle θ of the C-shaped core at the central part in the axial direction of the heat generating roller 130, the unevenness in temperature at the end parts in the axial direction of the heat generating roller 130 in which temperature drastically falls can be improved.

The angle θ of the C-shaped cores are gradually changed (for instance, increased) from the central part in the axial direction to the end parts in the axial direction of the heat generating roller 130, so that the unevenness in temperature in the axial direction of the heat generating roller 130 can be likewise improved.

In the above embodiment, although the width of the C-shaped cores 240 is the same, the width may be independently set for each of the C-shaped cores 240 so that the temperature adjustment of the heat generating roller 130 can be controlled. For example, the width of the C-shaped cores is changed from the central part in the axial direction to the end parts in the axial direction of the heat generating roller 130 (for instance, increased). Thus, the unevenness in temperature in the axial direction of the heat generating roller 130 can be improved.

Further, since the C-shaped cores 240 have the equal width and the plural C-shaped cores are arranged at large intervals in the direction of the rotation axis of the heat generating roller 130, heat is not accumulated in the back surface core 210 and the magnetizing coil 170. Further, there is no member for preventing the radiation of heat from the back surface core 210 and the outer periphery of the magnetizing coil 170. Thus, the saturation magnetic flux density of ferrite of the back surface core 210 is prevented from decreasing due to the rise of temperature resulting from stored heat, so that a magnetic permeability can be prevented from suddenly decreasing as a whole. Further, the insulating coat of the wires is prevented from being molten to short-circuit the wires. Thus, the heat generating roller 130 can be maintained at prescribed temperature in a stable manner for a long time.

Further, both the end parts of the magnetizing coil 170 in the direction of rotation axis of the heat generating roller 130 are formed by overlapping the bundles of wires. Thus, the magnetizing coil 170 can be uniformly drawn in the direction of the rotation axis of the heat generating roller 130 over a wider range. Thus, a uniform heat generating distribution of the heat generating roller 103 can be obtained. On the contrary, while a uniform heat generating area is ensured, the width of the magnetizing coil 170 at both the end parts in the direction of the rotation axis of the heat generating roller 130 can be decreased. Thus, the device can be entirely miniaturized.

In this embodiment, the recording sheet of the maximum width, the back surface core 210, the fixing belt 230, the outer peripheral part of the magnetizing coil 170, the heat insulating member 260 and the heat generating roller 130 are arranged in order of smaller length in the direction of the rotation axis of the heat generating roller. That is, the length of the heat insulating member 260 is longer than the length of the magnetizing coil 170 and the back surface core 210. The back surface core 210 is opposed to the heat generating roller 130 and the fixing belt 230 through the heat insulating member 260. Accordingly, even when the back surface core 210 is allowed to come near to the heat generating roller 130, the rise of temperature of the back surface core 210 can be prevented. Further, cooling air flow can be prevented from coming into contact with the fixing belt 230 to cool the fixing belt 230.

Further, the width of the fixing belt 230 is longer than the length of the back surface core 210 in the direction of the rotation axis of the heat generating roller 130. Thus, a part of the heat generating roller 130 which does not come into contact with the fixing belt 230 is not heated, so that the temperature the heat generating roller in this part can be prevented from excessively rising.

Further, a coil cover 280 (see FIG. 8(*a*)) is provided so that a magnetic flux slightly leaking in the back surface of the back surface core 210 or high frequency electromagnetic wave generated from the magnetizing coil 170 can be prevented from being propagated inside and outside the device. As a result, the malfunction of electric circuits provided inside and outside the device due to electromagnetic noise can be prevented.

Further, in this embodiment, the heat generating roller 130 (heat generating part) is disposed in the inner part of the fixing belt 230, and the magnetizing coil 170 and the back surface core 210 are disposed in the outer part of the fixing belt 230. Accordingly, the magnetizing coil 170 or the like can be prevented from receiving the influence of temperature of the heat generating part to rise the temperature. Therefore, the quantity of generated heat can be maintained in a stable way. Specially, the magnetizing coil 170 and the back surface core 210 are used which have the cross-sectional area larger than the cross-sectional area of a plane of the heat generating roller 130 vertical to the rotation axis therein. Accordingly, the heat generating roller 130 low in its thermal capacity, the magnetizing coil 170 having the large number of windings and a suitable amount of ferrite (back surface core 210) can be combined together and this combination can be used. Therefore, while the thermal capacity of the fixing device 120 is suppressed, much electric power can be supplied to the heat generating roller 130 under prescribed coil current. As a result, the inexpensive magnetizing circuit 180 (see FIG. 3) low in its withstand current and withstand voltage is used to realize the fixing device 120 having short warm-up time. In this embodiment, when ac current from the magnetizing circuit 180 has effective value voltage of 140V (voltage amplitude of 500 V) and effective value current of 22A (peak current of 55A), the electric power of 800W can be supplied to the heat generating roller 130.

Since the magnetizing coil 170 located outside the heat generating roller 130 generates heat on the surface of the heat generating roller 130, the fixing belt 230 comes into contact with the part of the heat generating roller 130 having the largest quantity of generated heat. Accordingly, the maximum heat generation part serves as a part for transmitting heat to the fixing belt 230. The generated heat can be transmitted to the fixing belt 230 without a thermal conduction in the heat generating roller 130. As described above, since a heat transmitting distance is small, a control quick in response to the change of temperature of the fixing belt 230 can be performed.

A temperature sensor (not shown) is provided in the vicinity of a position after passing the part where the heat generating roller 130 comes into contact with the fixing belt 230. The temperature of this part is controlled to prescribed temperature, so that the temperature of the fixing belt 230 when the fixing belt 230 enters the nip part between a fixing roller 270 and a pressure roller 160 can be constantly maintained at prescribed temperature. As a result, even when a plurality of recording sheets 200 are continuously fixed, they can be fixed in a stable way.

Further, the magnetizing coil 170 and the back surface core 210 covers substantially a half of the circumference of the heat generating roller 130. Accordingly, all the areas of the contact parts of the fixing belt 230 and the heat generating roller 130 generate heat. Therefore, heat energy transmitted from the magnetizing coil 170 to the heat generating roller 130 under the electromagnetic induction can be more transmitted to the fixing belt 230.

In this embodiment, the qualities of materials and thickness of the heat generating roller 130 and the fixing belt 230 can be respectively independently set. Accordingly, as the quality of material and the thickness of the heat generating roller 130, optimum quality of material and thickness can be selected for heating under the electromagnetic induction of the magnetizing coil 170. Further, as the quality of material and thickness of the fixing belt 230, optimum quality of material and thickness for fixing can be selected.

In this embodiment, to achieve a purpose of shortening warm-up time, the thermal capacity of the fixing belt 230 is set to a small value as much as possible. Further, the thickness and the outside diameter of the heat generating roller 130 are set to small values and the thermal capacity thereof is set to a small value. Therefore, prescribed temperature can be obtained in about 15 seconds after the start of rise of temperature for fixing under the supplied electric power of 800 W.

In this embodiment, although the C-shaped cores 240 are arranged at equal intervals in the direction of the rotation axis of the heat generating roller 130, the intervals may not be necessarily equal. The intervals are adjusted depending on a heat radiating state, the presence or absence of a contact member such as a temperature sensor, so that the heat generating distribution can be freely designed so as to have a uniform temperature distribution.

Further, in this embodiment, the back surface core 210 comprises a plurality of C-shaped cores 240 made of ferrite, having the equal thickness and arranged at intervals in the direction of the rotation axis of the heat generating roller 130 and the central core 250 also made of ferrite. However, the back surface core is not necessarily limited to this structure. For example, a plurality of holes may be formed on an integral back surface core 210 continuous in the direction of the rotation axis of the heat generating roller 130. Further, a plurality of blocks made of ferrite may be respectively independently distributed on the back surface of the magnetizing coil 170.

In this embodiment, although the base material of the fixing belt 230 is made of a resin, ferromagnetic metal such as nickel may be used in place of the resin. In this case, a part of generated heat by the electromagnetic induction is produced in this fixing belt 230 and the fixing belt 230 itself is also heated, so that the heat energy can be more effectively transmitted to the fixing belt 230.

Figure 13:
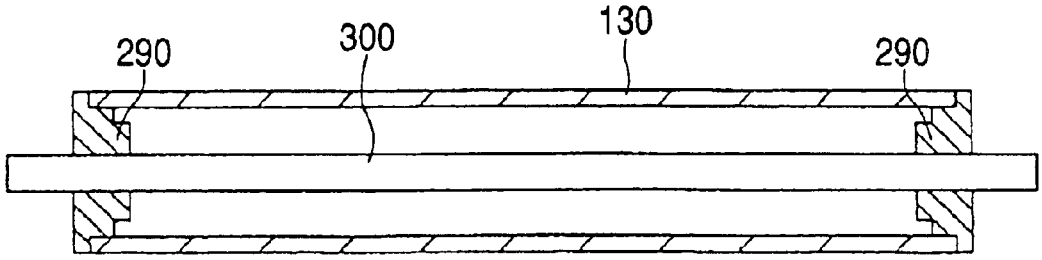
FIG. 13 is a sectional view showing the heat generating roller of the fixing device as the image heater in the third embodiment of the present invention.

Further, in this embodiment, both the ends of the heat generating roller 130 are supported by bearings 150. However, as shown in FIG. 13, the heat generating roller 130 may be supported by flanges 290 provided at both the ends of the heat generating roller 130 and made of a heat resistant resin low in its thermal conductivity such as Bakelite. In addition, a central shaft 300 passing through both the flanges 290 may be provided. The use of this structure makes it possible to suppress the leakage of heat or a magnetic flux from both the ends of the heat generating roller 130.

In this embodiment, the magnetizing width of the magnetizing coil 170 in the direction of movement of the fixing belt 230 is set to a range (winding range) where the fixing belt 230 comes into contact with the heat generating roller 130 or smaller. However, the present invention is not necessarily limited to this structure. For example, as shown in FIG. 8(*b*), the magnetizing width of the magnetizing coil 170 in the direction of movement of the fixing belt 230 may be extended toward the fixing roller 270 side from a range (winding range; boundary line of b) where the fixing belt 230 comes into contact with the heat generating roller 130. According to this structure, since heat can be generated in a wider range (range shown by a in FIG. 8(*b*)) of the heat generating roller 130 than that in the structure shown in FIG. 8(*a*), an adequate quantity of generated heat can be obtained under small coil current. In this case, after the bundle of wires is wound to form the magnetizing coil 170, the magnetizing coil 170 is compressed to have a section of a substantially rectangular form of the wound bundle of wires. Thus, the bundles of wires are made to mutually come into closer contact. Thus, since the occupied volume of the magnetizing coil 170 can be reduced, the number of windings of the magnetizing coil 170 can be more increased. As a result, since the current density of the coil current is increased, the density of eddy current generated in the heat generating roller 130 is also increased to increase the quantity of generated heat. Therefore, required coil current can be decreased or the diameter of the heat generating roller can be decreased. Further, since the space between the back surface core 210 and the magnetizing coil 170 can be increased, the heat radiation of the back surface core 210 can be accelerated and the rise of temperature of the back surface core 210 can be prevented. Further, since the bundles of wires come into tight contact with each other, the bundles of wires are securely bonded to each other. The magnetizing coil 170 can independently maintain its form. Accordingly, the assembly steps of the fixing device 120 are simplified.

(Fourth Embodiment)

Figure 14:
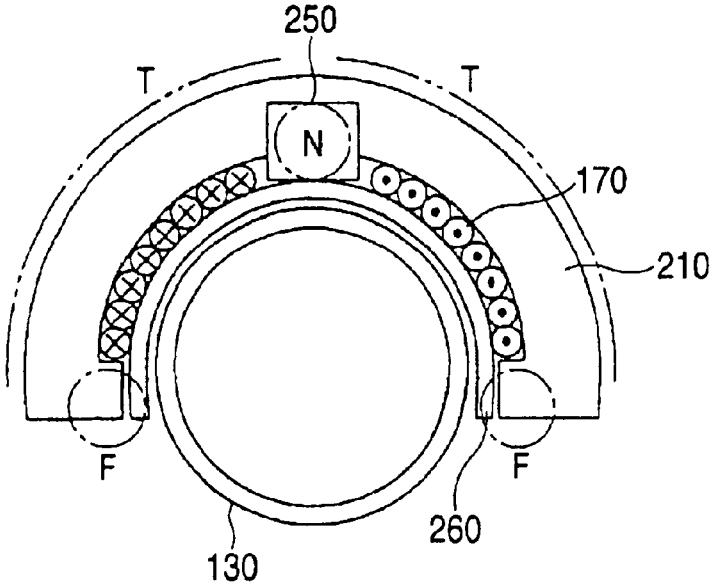
FIG. 14 is a sectional view showing a heat generating part of a fixing device as an image heater in a fourth embodiment of the present invention.

FIG. 14 is a sectional view showing a heat generating part of a fixing device as an image heater according to a fourth embodiment of the present invention. Members having the same functions as those of the third embodiment are designated by the same reference numerals and an explanation thereof will be omitted.

As shown in FIG. 14, in the fourth embodiment, opposed parts F of a back surface core 210 opposed to a heat generating roller 130 protrude so as to come near to the heat generating roller 130.

Other structures are the same as those of the third embodiment.

In the structure of this embodiment, a magnetic path is substantially completely made of ferrite. Accordingly, air parts low in magnetic permeability which a magnetic flux generated by coil current passes are located only in narrow gap parts between the heat generating roller 130 and the back surface core 210. Accordingly, the inductance of the magnetizing coil 170 is more increased and magnetic flux generated by the coil current is substantially completely introduced to the heat generating roller 130. As a result, an electromagnetic coupling between the heat generating roller 130 and the magnetizing coil 170 is improved and R in the equivalent circuit shown in FIG. 5 is increased. Accordingly, more electric power can be supplied to the heat generating roller 130 under the same coil current. In this embodiment, electric power of 800 W can be supplied to the heat generating roller 130 under effective value current of 20A (peak current of 50A).

Further, the back surface core 210 is opposed to the heat generating roller 130 and a fixing belt (not shown) through a heat insulating member 260. Accordingly, even when the back surface core 210 is made to come near to the heat generating roller 130, the temperature of the back surface core 210 is prevented from rising.

(Fifth Embodiment)

Figure 15:
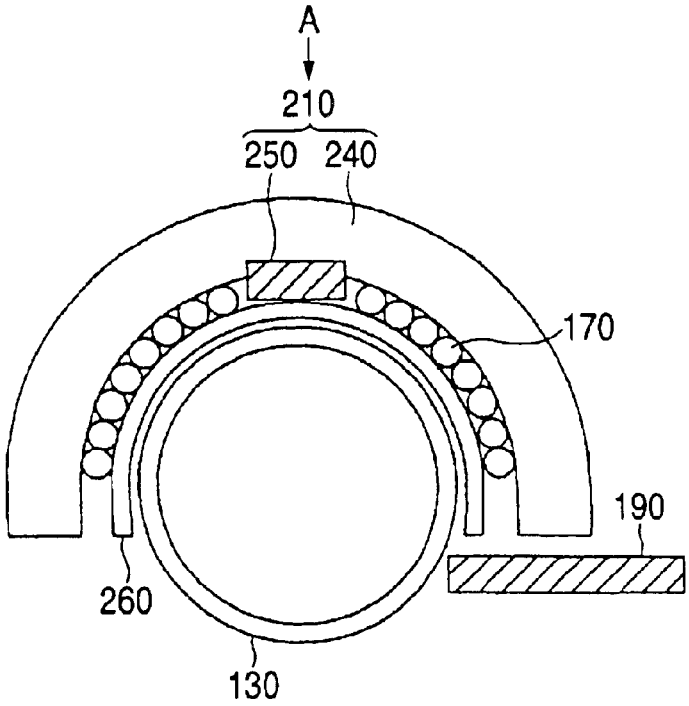
FIG. 15 is a sectional view showing a heat generating part of a fixing device as an image heater in a fifth embodiment of the present invention.
Figure 16:
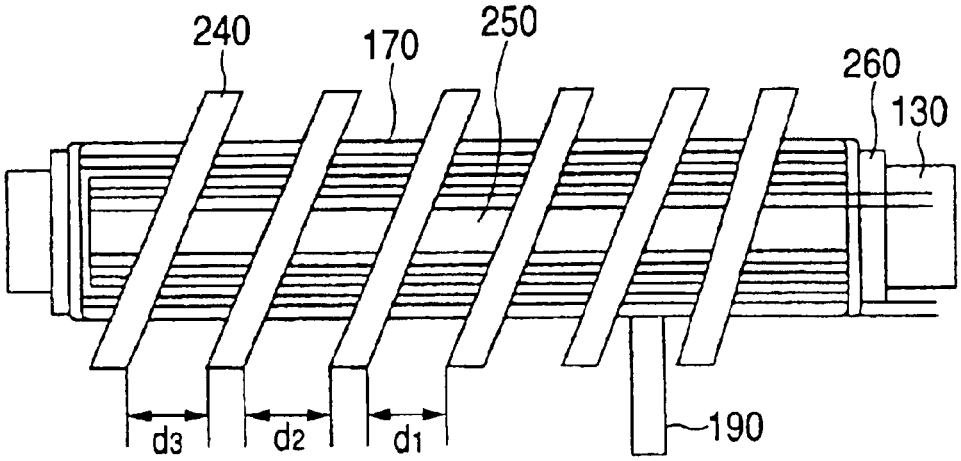
FIG. 16 is a projection drawing showing the heat generating part of the fixing device as the image heater in the fifth embodiment of the present invention viewed from a direction shown by an arrow mark A in FIG. 15.

FIG. 15 is a sectional view showing a heat generating part of a fixing device as an image heater according to a fifth embodiment of the present invention. FIG. 16 is a projection drawing of the heat generating part viewed from a direction shown by an arrow maker A in FIG. 15. Members having the same functions as those of the third embodiment are designated by the same reference numerals and an explanation thereof will be omitted.

As shown in FIGS. 15 and 16, the fifth embodiment is different from the third embodiment from the viewpoint that spaces between adjacent C-shaped cores 240 are changed along the direction of the rotation axis of a heat generating roller 130. In FIG. 16, d1 is 21 mm, d2 is 21 mm and d3 is 18 mm. Accordingly, they have a relation of d1=d2>d3. That is, the spaces between the adjacent C-shaped cores 240 of the back surface core 210 at the end parts of the heat generating roller 130 are narrow. In this case, the spaces may be set so as to have a relation of d1>d2>d3 in place of a relation of d1=d2. That is, the spaces between the C-shaped cores 240 are gradually decreased from a central part to end parts in the axial direction of the heat generating roller 130. Thus, unevenness in temperature in the axial direction of the heat generating roller 130 can be prevented and unevenness in fixing resulting therefrom can be prevented.

When the spaces between the adjacent C-shaped cores 240 are equal, the temperature of the end parts of the heat generating roller 130 and the fixing belt may be possibly low. Then, the unevenness in temperature in the axial direction of the heat generating roller 130 causes the unevenness in fixing.

As described above, in this embodiment, the spaces between the adjacent C-shaped cores 240 at the end parts of the heat generating roller 130 are narrower than those in a central part thereof. Accordingly, a magnetic flux generated by coil current is slightly increased more in the end parts of the heat generating roller 130 than that in the central part of the heat generating roller 130. Therefore, the quantity of generated heat is increased in the end parts of the heat generating roller 130. On the other hand, in the end parts of the heat generating roller 130, heat is easily taken away due to a thermal conduction to bearings more than that in the central part. Consequently, both actions are offset so that the temperature distribution of the heat generating roller 130 and the fixing belt becomes uniform. Thus, insufficient fixing can be prevented.

In this embodiment, the spaces between the adjacent C-shaped cores 240 at the end parts of the heat generating roller 130 are made narrow to obtain the uniform temperature distribution. However, the present invention is not necessarily limited to this structure. For example, the spaces between the adjacent C-shaped cores 240 may be equal. Further, the width of the C-shaped cores 240 located at the end parts of the heat generating roller 130 may be larger than the width of the C-shaped cores 240 located at the central part of the heat generating roller 130. Thus, the uniform temperature distribution can be likewise obtained. Furthermore, for example, the spaces between the adjacent C-shaped cores 240 may be equal and blocks made of ferrite may be independently arranged in ranges near the end parts of the heat generating roller 130 to obtain likewise the uniform temperature distribution.

(Sixth Embodiment)

Now, a fixing device used for the above-described image forming apparatus will be described below.

Figure 17:
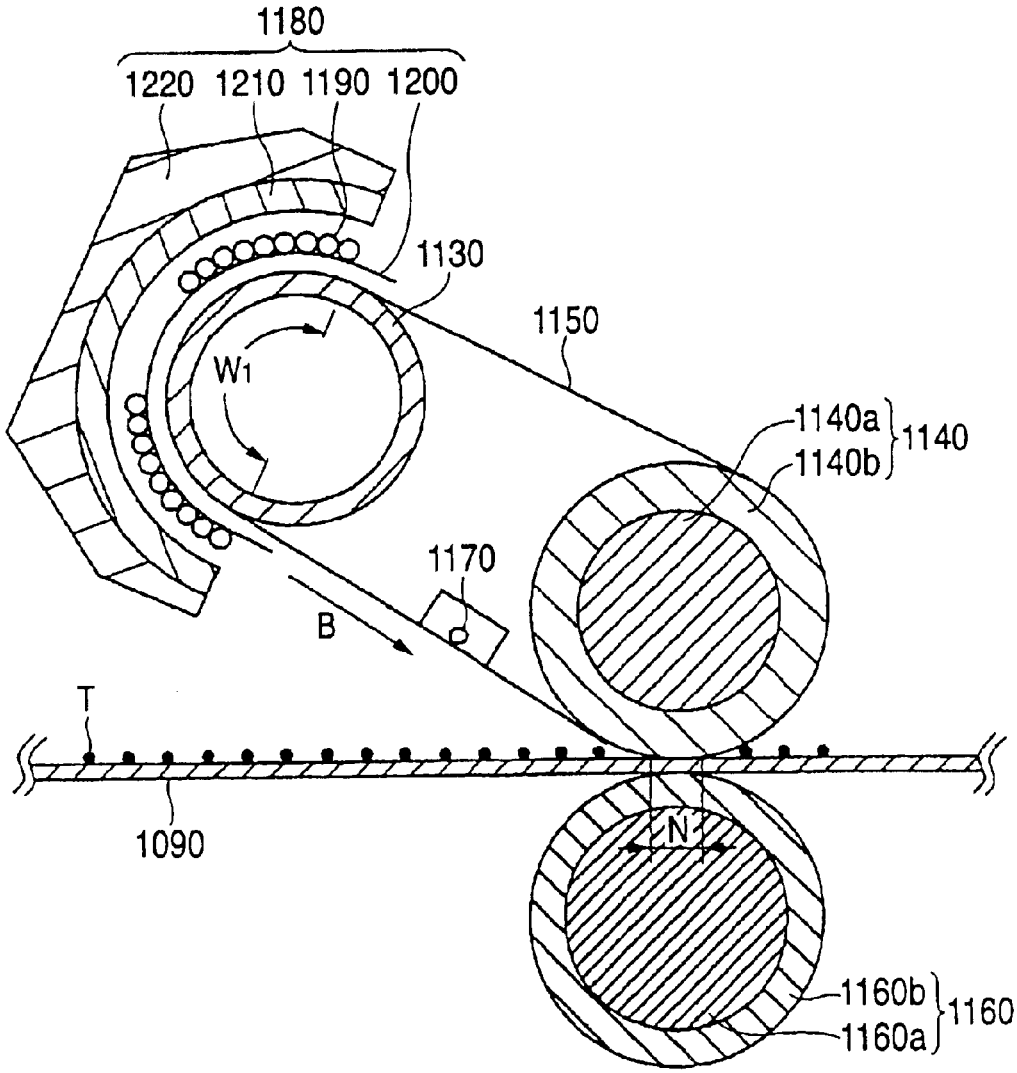
FIG. 17 is an explanatory view showing the structure of the fixing device according to sixth embodiment of the present invention used for the image forming apparatus shown in FIG. 1.

As shown in FIG. 17, the fixing device comprises a heat roller (heat generating member) 1130 heated by an electromagnetic induction of inductive heating means 1180, a fixing roller 1140 disposed in parallel with the heat roller 1130, an endless belt shaped heat resistant belt (toner heating medium) 1150 and a pressure roller 1160 pressed to come into contact with the fixing roller 1140 through the heat resistant belt 1150 and rotating in the forward direction relative to the heat resistant belt 1150. The endless belt shaped heat resistant belt 1150 extends on the heat roller 1130 and the fixing roller 1140, heated by the heat roller 1130 and rotating in the direction shown by an arrow mark B under the rotation of at least any one of these rollers.

The heat roller 1130 is formed by a rotating member composed of a hollow cylindrical magnetic metal member made of cobalt, nickel or alloy of these metals. The rotating member has an outside diameter of, for instance, 20 mm and thickness of, for instance, 0.3 mm and a low thermal capacity and is rapid in rise of temperature.

Figure 18:
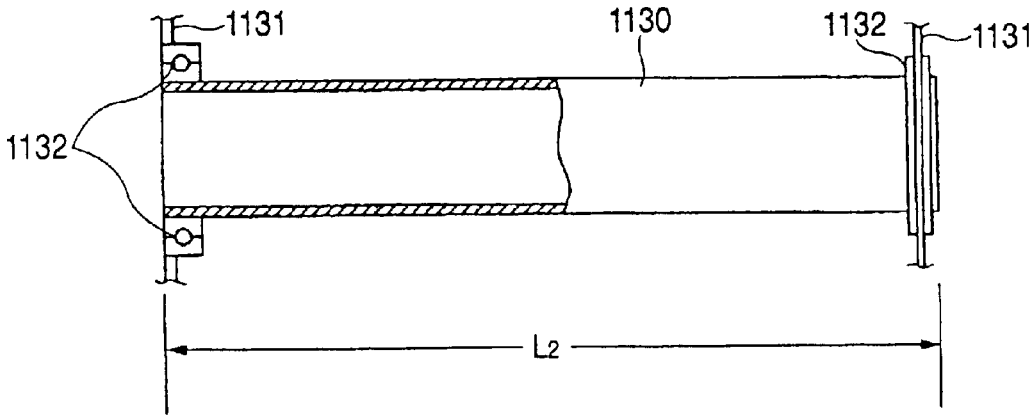
FIG. 18 is an explanatory view showing fragmentarily the structure of a heat roller forming the fixing device shown in FIG. 17.

The heat roller 1130 has both ends supported to freely rotate by bearings 1132 fixed to support side plates 1131 made of steel plates plated with zinc as shown in FIG. 18. The heat roller 1130 is driven to rotate by driving means of a device main body that is not illustrated. The heat roller 1130 is made of a magnetic material composed of an alloy of iron, nickel and chromium and is adjusted so that its Curie point is 300° C. or higher. Further, the heat roller 1130 is formed in the shape of a pipe having the thickness of 0.3 mm.

The surface of the heat roller 1130 is coated with a mold releasing layer (not shown) made of a fluorine resin having the thickness of 20 μm to apply mold releasing characteristics thereto. As the mold releasing layer, a resin or rubber good in its mold releasing characteristics such as PTFE, PFA, FEP, silicone rubber, fluorine rubber, etc. may be independently used or mixed and used. When the heat roller 1130 is used for fixing a monochromatic image, only the mold releasing characteristics may be ensured. However, when the heat roller 1130 is used for fixing a color image, elasticity is desirably applied to the heat roller. In that case, a thick rubber layer further needs to be formed.

The fixing roller 1140 comprises a core metal 1140*a* made of metal such as stainless steel and an elastic member 1140*b* made of solid state or foaming silicone rubber having a heat resistance with which the core metal 1140*a* is coated. Then, the fixing roller 1140 has the outside diameter of about 30 mm larger than that of the heat roller 1130. Thus, a fixing nip part N of a prescribed width is formed between the pressure roller 1160 and the fixing roller 1140 under a pressing force from the pressure roller 1160. The elastic member 1140*b* has the thickness of about 3 to 8 mm and the hardness of 15 to 50° (Asker hardness: 6 to 25° based on hardness of JIS A) . According to this structure, since the thermal capacity of the heat roller 130 is lower than the thermal capacity of the fixing roller 1140, the heat roller 1130 is rapidly heated to decrease a warming up time.

The heat resistant belt 1150 extending on the heat roller 1130 and the fixing roller 1140 is heated in a part W1 which comes into contact with the heat roller 1130 heated by the inductive heating means 1180. The inner surface of the heat resistant belt 1150 is continuously heated by the rotation of the heat roller 1130 and the fixing roller 1140, so that the belt is heated throughout its all parts.

Now, the structure of the heat resistant belt employed for the fixing device will be described below.

Figure 19:
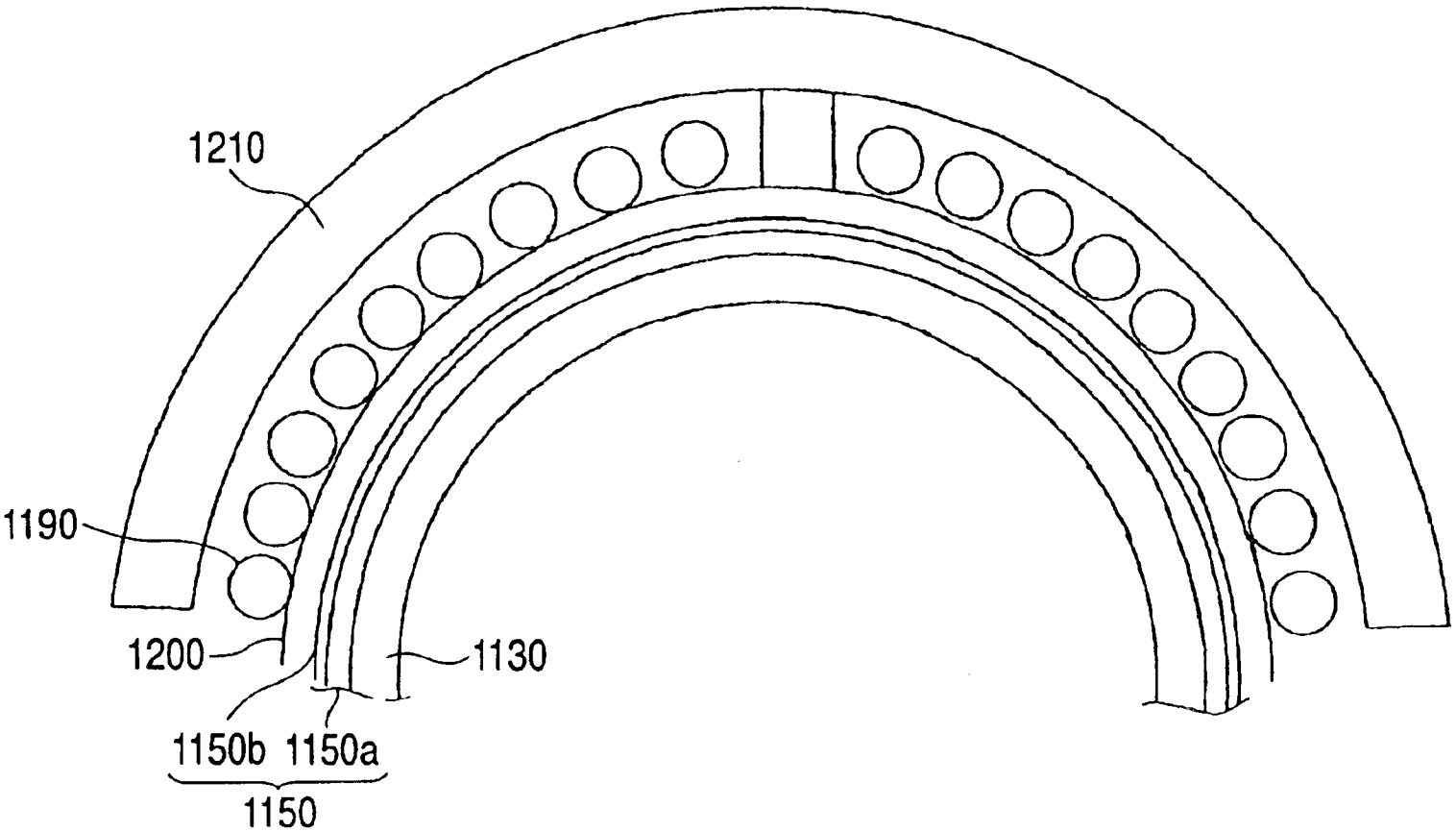
FIG. 19 is an explanatory view showing the structure of a heat resistant belt forming the fixing device shown in FIG. 17.

As shown in FIG. 19, the heat resistant belt 1150 is a compound layer belt composed of a heat generating layer 1150*a* made of, as a base, magnetic metal such as iron, cobalt, nickel, etc. or an alloy of them as base materials. Further, the compound layer belt is composed of a mold releasing layer 1150*b* made of an elastic member such as silicone rubber, fluorine rubber, etc. provided so as to cover the surface of the heat generating layer 1150*a*.

When the compound layer belt is used, not only the belt can be directly heated, but also a heat generating efficiency is improved and a quick response can be obtained.

For instance, foreign materials may possibly enter between the heat resistant belt 1150 and the heat roller 1130 to form a gap due to any cause. Even in this case, since the heat resistant belt 1150 itself generates heat due to the generation of heat by the electromagnetic induction of the heat generating layer 1150*a* of the heat resistant belt 1150, unevenness in temperature is hardly produced to improve a reliability in fixing.

The thickness of the heat generating layer 1150*a* desirably ranges from 20 μm to 50 μm and is particularly desirably about 30 μm.

As described above, when the heat generating layer 1150*a* is formed by using, as the base, the magnetic metal such as iron, cobalt, nickel, etc. or the alloy of them as the base materials, the thickness of the heat generating layer 1150*a* may be larger than 50 μm. In this case, distortion stress generated upon rotation of the belt is high and cracks are produced due to a shearing force or mechanical strength is extremely deteriorated. Further, when the thickness of the heat generating layer 1150*a* is smaller than 20 μm, cracks or damage are generated in the compound belt layer due to thrust load on the end parts of the belt resulting from a zigzag movement of the belt upon rotation of the belt.

On the other hand, the mold releasing layer 1150*b* desirably has the thickness of about 100 μm to 300 μm, and especially desirably has the thickness of about 200 μm. In such a way, the toner images T formed on the sheet material 1090 are adequately enclosed by the surface layer part of the heat resistant belt 1150, so that the toner images T can be uniformly heated and molten.

When the thickness of the mold releasing layer 1150*b* is smaller than 100 μm, the thermal capacity of the heat resistant belt 1150 is decreased. Thus, the surface temperature of the belt is rapidly lowered in a step of fixing the toner so that a fixing performance cannot be adequately ensured. Further, when the thickness of the mold releasing layer 1150*b* is larger than 300 μm, the thermal capacity of the heat resistat belt 1150 is increased. Thus, it takes much time to warm up the belt. In addition, in the step of fixing the toner, the surface temperature of the belt is hardly lowered, so that the condensation effect of the molten toner cannot be obtained in the outlet of a fixing part. Further, what is called a hot offset that the mold releasing characteristics of the belt are deteriorated and the toner adheres to the belt is generated.

The inner surface of the heat resistant layer 1150*a* may be coated with a resin for the purpose of preventing the oxidation of metal and improving the contact with the heat roller 1130.

As the base of the heat resistant belt 1150, a resin layer having a heat resistance may be used in place of the heat generating layer 1150*a* made of the above-described metals. The resin layer is made of resins having the heat resistance such as a fluorine resin, a polyimide resin, a polyamide resin, a polyamide-imide resin, a PEEK resin, a PES resin, a PPS resin, etc.

When the base is composed of the resin layer as a resin member high in its heat resistance, the heat resistant belt 1150 easily comes into tight contact with the heat roller 1130 in accordance with the curvature of the heat roller 1130. Accordingly, heat retained in the heat roller 1130 is efficiently transmitted to the heat resistant belt 1150. Further, since the resin layer is made of resin, the resin layer has an effect that the resin layer is hardly broken. In this case, the thermal conductivity of a metallic layer is higher than that of the resin layer.

In this case, the thickness of the resin layer desirably ranges from approximately 20 μm to 150 μm, and is especially desirably about 75 μm. When the thickness of the resin layer is smaller than 20 μm, a mechanical strength for the zigzag movement of the belt upon rotation of the belt cannot be obtained Further, when the thickness of the resin layer is larger than 150 μm, the thermal propagation efficiency from the heat roller 1130 to the mold releasing layer 1150*b* of the heat resistant belt 1150 is lowered. Besides, the deterioration of the fixing performance is generated, because the thermal conductivity of the resin is low.

In FIG. 17, the pressure roller 1160 comprises a core metal 1160*a* made of a metallic cylindrical member having high thermal conductivity such as copper or aluminum or the like. The pressure roller 1160 further comprises an elastic member 1160*b* high in its heat resistance and toner mold releasing characteristic provided on the surface of the core metal 1160*a*. For the core metal 1160*a*, SUS may be used except the above-described metals.

The pressure roller 1160 presses the fixing roller 1140 through the heat resistant belt 1150 to form a fixing nip part N for holding and conveying the sheet material 1090. In this embodiment, the hardness of the pressure roller 1160 is made higher than that of the fixing roller 1140. Consequently, the pressure roller 1160 bites the fixing roller 1140 (and the heat resistant belt 1150). The bite of the pressure roller 1160 allows the sheet material 90 to extend along the circumference configuration of the surface of the pressure roller 1160. Therefore, the sheet material 1090 is effectively and easily separated from the surface of the heat resistant belt 1150. The outside diameter of the pressure roller 1160 is the same as that of the fixing roller 1140 that is about 30 mm. The thickness of the pressure roller 1160 is about 2 to 5 mm that is smaller than that of the fixing roller 1140. Further, the hardness of the pressure roller 1160 is about 20 to 60° (Asker hardness: 6 to 25° based on hardness of JIS A) than is higher than that of the fixing roller 1140 as described above.

Now, the inductive heating means 1180 will be described below.

Figure 20:
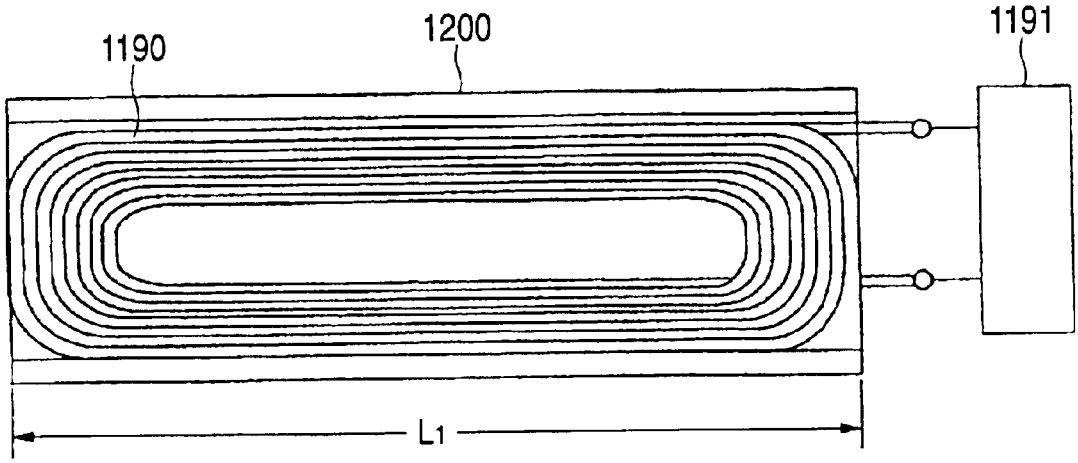
FIG. 20 is an explanatory view showing a part of inductive heating means forming the fixing device shown in FIG. 17.

The inductive heating means 1180 for heating the heat roller 1130 by the electromagnetic induction is disposed to be opposed to the outer peripheral surface of the heat roller 1130 as shown in FIG. 17. As shown in FIGS. 17 and 20, the inductive heating means 1180 includes a magnetizing coil 1190 as magnetic field generating means and a coil guide plate 1200 on which the magnetizing coil 1190 is wound. The coil guide plate 1200 has a semi-circular cylindrical configuration arranged near the outer peripheral surface of the heat roller 1130. The magnetizing coil 1190 is formed in such a way that a bundle of wires whose surfaces are insulated is wound so as to be drawn in the direction of a rotation axis of the heat roller 1130 along the coil guide plate 1200. The magnetizing coil is wound along the direction of the circumference of the heat roller 1130.

In this embodiment, the number of twisted wires of the magnetizing coil 1190 is 40 that are wound nine times.

Figure 21:
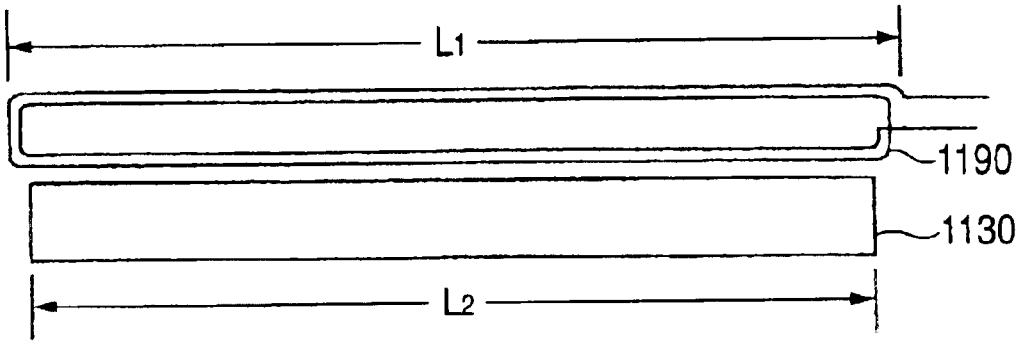
FIG. 21 is an explanatory view showing a dimensional relation and a positional relation between a magnetizing coil and the heat roller.
Figure 22:
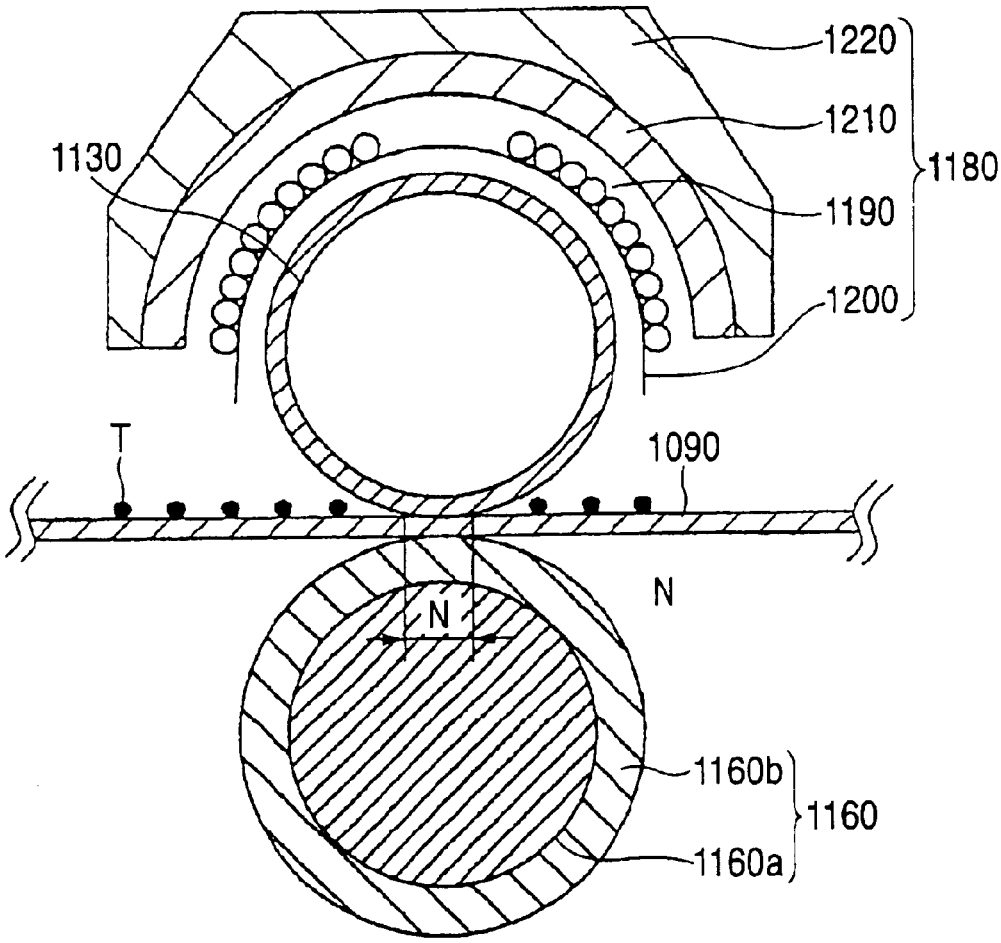
FIG. 22 is an explanatory view showing the structure of a fixing device according to another embodiment of the present invention used for the image forming apparatus shown in FIG. 1.

Here, as shown in FIG. 21, assuming that the entire length of the magnetizing coil 1190 as the length in the direction of rotation axis of the heat roller 1130 is L1 and the entire length of the heat roller 1130 as the length in the direction of rotation axis of the heat roller 1130 is L2, both the lengths have a dimensional relation that L1 is larger than L2. The heat roller 1130 is arranged so that its entire length is located within the entire length of the magnetizing coil 1190.

In the magnetizing coil 1190, an alternating magnetic field is produced. Since this magnetic field may be unstable in the end parts of the magnetizing coil 1190, unevenness is generated in Joule heat produced by eddy current in the heat roller 1130 due to the unstable magnetic filed.

As described above, in the fixing device, the entire length L1 of the magnetizing coil 1190 is longer than the entire length L2 of the heat roller 1130. Further, the heat roller 1130 is arranged so that the entire length of the heat roller is located within the entire length of the magnetizing coil 1190. Accordingly, the heat roller 1130 does not receive the influence of the unstable magnetic filed produced in the end parts of the magnetizing coil 1190. The heat roller 1130 can uniformly generate heat without unevenness by the inductive heating means 1180.

In the magnetizing coil 1190, an oscillating circuit is connected to a frequency variable driving power source 1191.

In the outer part of the magnetizing coil 1190, a semi-circular cylindrical magnetizing coil core 1210 made of a ferromagnetic member such as ferrite is fixed to a magnetizing coil core support member 220 to be arranged near the magnetizing coil 1190. In this embodiment, the magnetizing coil core 1210 having the relative magnetic permeability of 2500 is employed.

Referring to FIG. 19, in the fixing device having the above-described structure, high frequency ac current of 10 kHz to 1 MHz, preferably, high frequency ac current of 20 kHz to 800 kHz is fed to the magnetizing coil 1190 from the driving power source. Thus, an alternating magnetic field is produced. Then, this alternating magnetic field acts on the heat roller 1130 and the heat generating layer 1150*a* of the resistant belt 1150 in an area W1 where the heat roller 1130 comes into contact with the heat resistant belt 1150 and a part in the vicinity thereof. Thus, the eddy current is supplied so as to prevent the change of the alternating magnetic field therein.

This eddy current allows Joule heat corresponding to the resistance of the heat roller 1130 and the heat generating layer 150*a*. Thus, the heat roller 1130 and the resistant belt 1150 having the heat generating layer 1150*a* mainly in the area where the heat roller 1130 comes into contact with the heat resistant belt 1150 and the part in the vicinity thereof are electro-magnetically and inductively heated.

The inner surface temperature of the heat resistant belt 1150 heated in such a manner is detected by temperature detecting means 1170. The temperature detecting means 1170 is made of a temperature sensing element high in its heat responsiveness such as a thermistor that abuts on the inner surface side of the heat resistant belt 1150 near the inlet side of the fixing nip part N shown in FIG. 17.

Accordingly, the temperature detecting means 1170 does not break the surface of the heat resistant belt 1150, a fixing performance is continuously maintained and the temperature of the heat resistant belt 1150 immediately before the heat resistant belt 1150 enters the fixing nip part N is detected. Then, electric power supplied to the inductive heating means 1180 is controlled in accordance with a signal outputted based on this temperature information to maintain the temperature of the heat resistant belt 1150 in a stable manner to, for instance, 180° C.

In the above description, the structure in which the image is fixed by the fixing roller 1140 heated through the heat resistant belt 1150 from the heat roller 1130 whose heat is generated by the inductive heating means 1180 is shown. However, a structure in which the image is directly fixed by the heat roller 1130 without using the heat resistant belt 1150 may be employed.

Specifically, a fixing device may comprise, as shown in FIG. 21, a heat roller 1130 heated by the electromagnetic induction of inductive heating means 1180. The fixing device may further comprise a pressure roller 1160 that comes into contact with the heat roller 1130 under pressure and rotates in the forward direction relative to the heat roller 1130.

As described above, according to the present invention, the C-shaped cores are arranged at an angle relative to the axial direction of the heat roller so that an area of a section vertical to the axis of the heat roller is substantially the same at any part. With such a structure, the temperature difference in the axial direction of the heat roller is decreased and the generation of unevenness in fixing can be suppressed.

Further, according to the present invention, the entire length of the magnetizing coil is larger than the entire length of the heat generating means. Further, the heat generating means is arranged so that its entire length is located within the entire length of the magnetizing coil. Therefore, the heat generating means does not receive the influence of the unstable magnetic field produced in the end parts of the magnetizing coil, so that the heat generating means can effectively uniformly generate heat without unevenness by the inductive heating means.

What is claimed is:

1. A fixing device for an image forming apparatus comprising:

a heat roller to be heated by eddy current;

an induction heating element for generating the eddy current on said heat roller, said induction heating element being disposed along said heat roller to face at least a part of said heat roller;

a plurality of coil cores provided outside said induction heating element for covering a part of said induction heating element, said plurality of coil cores being arranged at an interval in a longitudinal direction of said induction heating element, said plurality of coil cores being arranged such that a longitudinal direction of one of said plurality of coil cores forms a predetermined angle with said longitudinal direction of said induction heating element.

2. The fixing device as claimed in claim 1, wherein said predetermined angle is an acute angle.

3. The fixing device as claimed in claim 2, wherein said plurality of coil cores are arranged at two different intervals in said longitudinal direction of said induction heating element.

4. The fixing device as claimed in claim 1, wherein said predetermined angle and said interval are arranged such that heat distribution of said heat roller is approximately uniform in a longitudinal direction of said heat roller.

5. The fixing device as claimed in claim 1, wherein said plurality of coil cores are arranged such that a total cross section of said plurality of coil cores at a desired imaginary plane, which is orthogonal to said longitudinal direction of said induction heating element, is approximately uniform.

6. The fixing device as claimed in claim 3, wherein said plurality of coil cores are arranged such that said intervals become smaller as each of said coil cores is placed farther from a center of said induction heating element in said longitudinal direction of said induction heating element.

7. The fixing device as claimed in claim 2, wherein an interval at an end portion of the heat induction heating element is smaller than that of a center portion.

8. The fixing device as claimed in claim 2, wherein an angle defined by a coil core at end portion of the induction heating element with the longitudinal direction of the induction heating element is smaller than that of a center portion.

9. The fixing device as claimed in claim 1, further comprising a central core provided along with a longitudinal direction of said induction heating element.

10. The fixing device as claimed in claim 1, wherein said coil cores are C-shaped coil cores.

11. The fixing device as claimed in claim 1, wherein length of the induction heating element is larger than length of the heat roller and the heat roller is located within the length of the induction heating element.

12. An image forming apparatus comprising:

a fixing device for an image forming apparatus comprising:

a heat roller to be heated by eddy current;

an induction heating element for generating the eddy current on said heat roller, said induction heating element being disposed along said heat roller to face at least a part of said heat roller;

a plurality of coil cores provided outside said induction heating element for covering a part of said induction heating element, said plurality of coil cores being arranged at an interval in a longitudinal direction of said induction heating element, said plurality of coil cores being arranged such that a longitudinal direction of one of said plurality of coil cores forms a predetermined angle with said longitudinal direction of said induction heating element.

13. The image forming apparatus as claimed in claim 11, wherein said predetermined angle is an acute angle.

14. The image forming apparatus as claimed in claim 13, wherein said plurality of coil cores are arranged at two different intervals in said longitudinal direction of said induction heating element.

15. The image forming apparatus as claimed in claim 12, wherein said predetermined angle and said interval are arranged such that heat distribution of said heat roller is approximately uniform in a longitudinal direction of said heat roller.

16. The image forming apparatus as claimed in claim 12, wherein said plurality of coil cores are arranged such that a total cross section of said plurality of coil cores at a desired imaginary plane, which is orthogonal to said longitudinal direction of said induction heating element, is approximately uniform.

17. The image forming apparatus as claimed in claim 14, wherein said plurality of coil cores are arranged such that said intervals become smaller as each of said coil cores is placed farther from a center of said induction heating element in said longitudinal direction of said induction heating element.

18. The image forming apparatus as claimed in claim 13, wherein an interval at an end portion of the heat induction heating element is smaller than that of a center portion.

19. The image forming apparatus as claimed in claim 13, wherein an angle defined by a coil core at end portion of the induction heating element with the longitudinal direction of the induction heating element is smaller than that of a center portion.

20. The image forming apparatus as claimed in claim 12, further comprising a central core provided along with a longitudinal direction of said induction heating element.

21. The image forming apparatus as claimed in claim 12, wherein said coil cores are C-shaped coil cores.

22. The image forming apparatus as claimed in claim 13, wherein length of the induction heating element is larger than length of the heat roller and the heat roller is located within the length of the induction heating element.

23. A fixing device in which a plurality of C shaped cores provided so as to cover a coil are respectively slantwise arranged at an angle relative to the axial direction of a heat roller.

24. A fixing device for holding and conveying a recording medium by a fixing nip part, melting and pressing non-fixed toner on the recording medium to fix the non-fixed toner to the recording medium, said fixing device comprising:

a heat generating member having a rotating body made of a magnetic metal member; and an inductive heating unit having a magnetizing coil which is opposed to the outer peripheral surface of the heat generating member and has a bundle of wires with surfaces insulated drawn in the direction of a rotation axis of the heat generating member and wound along the direction of the circumference of the heat generating member and generates the heat of the heat generating member by an electromagnetic induction, wherein assuming that the entire length of the magnetizing coil as length in the direction of the rotation axis of the heat generating member is L1 and the entire length of the heat generating member as length in the direction of the rotation axis thereof is L2, L1 is larger than L2 and the heat generating member is arranged so that its entire length is located within the entire length of the magnetizing coil.

25. A fixing device according to claim 24, wherein a fixing roller to which the heat generating member or the heat of the heat generating member is transmitted forms the fixing nip part.

* * * * *